US012290097B2

(12) United States Patent
Yang et al.

(10) Patent No.: US 12,290,097 B2
(45) Date of Patent: May 6, 2025

(54) SMOKING ARTICLE COMPRISING A TUBE FILTER AND A METHOD OF MANUFACTURING THE SAME

(71) Applicant: KT&G CORPORATION, Daejeon (KR)

(72) Inventors: Jin Chul Yang, Sejong (KR); Jong Yeol Kim, Sejong (KR); Ki Jin Ahn, Daejeon (KR); Bong Su Cheong, Daejeon (KR); Hee Tae Jung, Daejeon (KR)

(73) Assignee: KT&G CORPORATION, Daejeon (KR)

( * ) Notice: Subject to any disclaimer, the term of this patent is extended or adjusted under 35 U.S.C. 154(b) by 861 days.

(21) Appl. No.: 17/431,369

(22) PCT Filed: Nov. 27, 2020

(86) PCT No.: PCT/KR2020/017114
§ 371 (c)(1),
(2) Date: Aug. 16, 2021

(87) PCT Pub. No.: WO2021/125613
PCT Pub. Date: Jun. 24, 2021

(65) Prior Publication Data

US 2022/0132913 A1 May 5, 2022

(30) Foreign Application Priority Data

Dec. 18, 2019 (KR) ..... 10-2019-0170232

(51) Int. Cl.
*A24D 3/02* (2006.01)
*A24C 5/01* (2020.01)
(Continued)

(52) U.S. Cl.
CPC ..... *A24D 3/025* (2013.01); *A24C 5/01* (2020.01); *A24C 5/476* (2013.01); *A24D 1/002* (2013.01);
(Continued)

(58) Field of Classification Search
None
See application file for complete search history.

(56) References Cited

U.S. PATENT DOCUMENTS 4,770,193 A * 9/1988 Pryor ..... A24D 3/022 131/342
2005/0211260 A1 9/2005 Sasaki et al.
(Continued)

FOREIGN PATENT DOCUMENTS

CN 101983018 A 3/2011
CN 206729213 U 12/2017
(Continued)

OTHER PUBLICATIONS

Asakura (WO 20160009555 A1) English Machine Translation (Year: 2016).*
(Continued)

*Primary Examiner* — Michael H. Wilson
*Assistant Examiner* — Daniel Edward Vakili
(74) *Attorney, Agent, or Firm* — Sughrue Mion, PLLC

(57) ABSTRACT

A method of manufacturing a smoking article including a tube filter includes preparing a smoking material portion, a first tube filter flavored by a first flavoring liquid, and a mouthpiece flavored by a second flavoring liquid; and combining and packaging the smoking material portion, the first tube filter, and the mouthpiece with a wrapper, wherein the preparing comprises applying the first flavoring liquid inside the first tube filter through a hollow of the first tube filter.

5 Claims, 9 Drawing Sheets

(51) Int. Cl.

| | |
|---|---|
| ***A24C 5/47*** | (2006.01) |
| ***A24D 1/00*** | (2020.01) |
| ***A24D 1/04*** | (2006.01) |
| ***A24D 1/20*** | (2020.01) |
| ***A24D 3/04*** | (2006.01) |
| ***A24D 3/08*** | (2006.01) |
| ***A24D 3/10*** | (2006.01) |
| ***A24D 3/14*** | (2006.01) |
| ***A24D 3/17*** | (2020.01) |
| ***A24D 3/18*** | (2006.01) |

(52) U.S. Cl.

CPC ..... *A24D 1/042* (2013.01); *A24D 1/045* (2013.01); *A24D 1/20* (2020.01); *A24D 3/0254* (2013.01); *A24D 3/0279* (2013.01); *A24D 3/048* (2013.01); *A24D 3/08* (2013.01); *A24D 3/10* (2013.01); *A24D 3/14* (2013.01); *A24D 3/17* (2020.01); *A24D 3/18* (2013.01)

(56) References Cited

U.S. PATENT DOCUMENTS

| | | | | |
|---|---|---|---|---|
| 2006/0052226 | A1 | 3/2006 | Rinke et al. | |
| 2008/0216851 | A1 | 9/2008 | Olegario et al. | |
| 2011/0036367 | A1 | 2/2011 | Saito et al. | |
| 2011/0120481 | A1* | 5/2011 | Besso ..... | A24D 3/062 428/401 |
| 2011/0277781 | A1 | 11/2011 | Clark | |
| 2013/0125905 | A1 | 5/2013 | Cooper | |
| 2017/0325496 | A1 | 11/2017 | Park et al. | |
| 2018/0064162 | A1* | 3/2018 | Fujita ..... | A24D 3/022 |
| 2020/0054067 | A1 | 2/2020 | Beghin et al. | |
| 2021/0007397 | A1 | 1/2021 | Thorens | |
| 2022/0132913 | A1 | 5/2022 | Yang et al. | |

FOREIGN PATENT DOCUMENTS

| | | | | | |
|---|---|---|---|---|---|
| CN | 108185517 | A | | 6/2018 | |
| CN | 207821080 | U | | 9/2018 | |
| CN | 110248560 | A | | 9/2019 | |
| GB | 2587508 | B | | 9/2021 | |
| JP | 2005-537814 | A | | 12/2005 | |
| JP | 2010-517568 | A | | 5/2010 | |
| JP | 2022-525870 | A | | 5/2022 | |
| KR | 10-0641726 | B1 | | 11/2006 | |
| KR | 10-2019-0015213 | A | | 2/2019 | |
| KR | 10-2019-0049135 | A | | 5/2019 | |
| KR | 10-2019-0094225 | A | | 8/2019 | |
| KR | 20210079166 | A | * | 6/2021 | |
| WO | WO-2016009555 | A1 | * | 1/2016 | ..... A24D 3/022 |
| WO | WO 2016/092295 | A1 | * | 6/2016 | ..... A24D 3/04 |
| WO | WO-2018154006 | A1 | * | 8/2018 | ..... A24D 1/002 |
| WO | 2019/201290 | A1 | | 10/2019 | |

OTHER PUBLICATIONS

Yang KR20210079166A Abstract English Machine Translation (Year: 2021).*

Japanese Office Action dated Nov. 29, 2022 in Japanese Application No. 2021-555323.

Communication dated Jun. 29, 2022 from the Chinese Patent Office in Chinese Application No. 202080043301.6.

Japanese Office Action issued Jun. 6, 2023, in Application No. 2021-555323.

International Search Report for PCT/KR2020/017114 dated Mar. 3, 2021 [PCT/ISA/210].

Notification of Reason for Refusal for 10-2019-0170232 dated Dec. 18, 2019.

Communication dated Sep. 17, 2024 issued by the Japanese Patent Office in application No. 2023173269.

* cited by examiner (a) (b) (c)

SMOKING ARTICLE COMPRISING A TUBE FILTER AND A METHOD OF MANUFACTURING THE SAME

TECHNICAL FIELD

The present disclosure relates to a smoking article comprising a tube filter and a method of manufacturing the same, and more particularly, to a smoking article comprising a tube filter which is flavored and/or moisturized through a hollow, and a method of manufacturing the same.

BACKGROUND ART

Research is being conducted on technology for adding a flavor to an aerosol provided from a cigarette. For example, to add a flavor to the aerosol, a transfer jet nozzle system (TJNS) filter and the like, in which a flavor is sprayed to a filter of a cigarette, is used for manufacturing cigarettes.

When the flavoring liquid is added to the inside of the filter through an external surface of the filter as in the related art, there is a limit in the amount of the flavoring liquid inserted in a manufacturing process due to, for example, external contamination through transfer of the flavoring liquid to a cigarette paper covering the outside of the filter. Also, menthol applied in the filter may be transferred to an adjacent unflavored tube filter and the like over time, and the amount of migration of menthol may rapidly decrease during smoking.

DISCLOSURE

Technical Problem

The present disclosure is devised to solve the above-described shortcomings and provide a smoking article and a method of manufacturing the same, the smoking article comprising a tube filter capable of significantly improving the taste of smoking and increasing an amount of migration of menthol, an amount of migration of nicotine, and an amount of smoke during smoking.

Technical goals of the present disclosure are not limited to the above-mentioned technical goals, and other technical goals that are not mentioned may be clearly understood by one of ordinary skill in the technical field of the present disclosure from the following descriptions.

Technical Solution

Various embodiments are to provide a smoking article and a method of manufacturing a smoking article. For example, a method of manufacturing a smoking article may comprise preparing a smoking material portion, a first tube filter flavored by a first flavoring liquid, and a mouthpiece flavored by a second flavoring liquid; and combining and packaging the smoking material portion, the first tube filter, and the mouthpiece with a wrapper, wherein the preparing comprises applying the first flavoring liquid inside the first tube filter through a hollow of the first tube filter. Technical goals to be achieved by the present disclosure are not limited to the technical goals described above, and other technical goals may be derived from following embodiments.

Advantageous Effects

When the tube filter is internally flavored according to embodiments of the inventive concept, a maximum amount of flavoring liquid, which is a larger amount of flavoring liquid compared to that in the existing TJNS flavoring treatment method, may be applied into the filter. In detail, considering a maximum flavoring amount applicable in the TJNS flavoring treatment method is about 0.5 mg/mm to about 0.8 mg/mm, a flavoring liquid may be applied up to about 1.2 times or twice more than the existing TJNS flavoring treatment method.

In addition, when a cigarette of an internally-flavored tube filter according to the embodiments of the present disclosure is used, loss of menthol applied to the TJNS filter that occurs during the cigarette storage period may be reduced, and at the same time, a migration amount of menthol to a cut tobacco filler portion may increase, and therefore, taste of menthol during smoking may be enhanced.

In addition, when the internally-flavored tube filter is located between the internally-moisturized tube filter and the TJNS filter, loss of flavor due to heat of the aerosol may be minimized.

Furthermore, the inside of the tube filter according to embodiments is flavored by the flavoring liquid free-falling into the hollow of the tube filter, and therefore, the flavoring liquid may be uniformly and sufficiently inserted into the tube without a complicated spray nozzle for spraying the flavoring liquid into the hollow of the tube. As a result, a manufacturing process may be simplified and manufacturing cost may be reduced.

In addition, when a flavoring treatment method, a treatment rate of flavoring liquid, a diameter of a flavoring nozzle, a separation distance between the flavoring nozzle and a steam nozzle and the like are applied to the process of manufacturing the tube filter, loss of flavor due to high-temperature steam may be minimized.

BEST MODE

Figure 1:
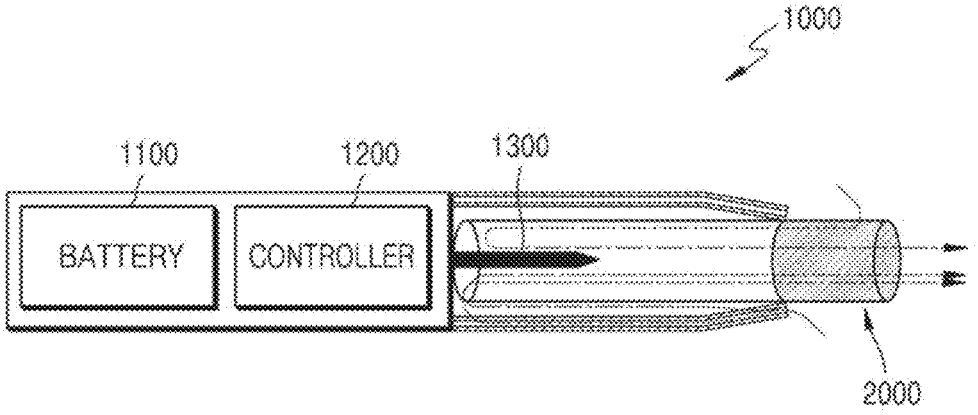
FIGS. 1 through 3 are diagrams showing examples in which a cigarette is inserted into an aerosol generating device.

According to some embodiments of the present disclosure, provided is a method of manufacturing a smoking article, the method comprising: preparing a smoking material portion, a first tube filter flavored by a first flavoring liquid, and a mouthpiece flavored by a second flavoring liquid; and combining and packaging the smoking material portion, the first tube filter, and the mouthpiece with a wrapper, wherein the preparing comprises applying the first flavoring liquid inside the first tube filter through a hollow of the first tube filter.

In some embodiments, the applying may include applying the first flavor liquid to an inner surface of the first tube filter in an amount of 0.3 mg to 1.0 mg per millimeter.

The applying may include comprises: applying the first flavoring liquid to the inner surface in an amount of 0.3 mg to 0.6 mg per millimeter, using a flavoring nozzle having a diameter of 0.8 mm to 1.1 mm, or applying the first flavoring liquid to the inner surface in an amount of 0.7 mg to 1.0 mg per millimeter, using the flavoring nozzle having a diameter of 1.2 mm to 1.4 mm.

The preparing may include: spraying, by a steam spray nozzle, steam of 80° C. to 150° C. onto an external surface of a tube-shaped rod, before applying the first flavoring liquid; and cutting the tube-shaped rod into the first tube filter after the first flavoring liquid is applied, wherein the first flavoring liquid contained in the first tube filter after the cutting is from 92% to 99.9% of a total amount of the first flavoring liquid applied to the first tube filter before the cutting.

In some embodiments, the flavoring nozzle and the steam spray nozzle may be apart from each other by 180 mm to 350 mm in a longitudinal direction of the first tube filter.

In some embodiments, an amount of the first flavoring liquid applied in the hollow of the first tube filter may be 1% to 200% of an amount of the second flavoring liquid applied in the mouthpiece. Alternatively, an amount of the first flavoring liquid applied in the hollow of the first tube filter may be from 10% to about 200% of an amount of the second flavoring liquid treated in the mouthpiece. Alternatively, an amount of the first flavoring liquid applied in the hollow of the first tube filter may be from 100% to 150% of an amount of the second flavoring liquid applied in the mouthpiece.

According to some other embodiments, there is provided a method of manufacturing a smoking article, the method comprising: preparing a smoking material portion, a first tube filter moisturized by a moisturizing liquid, and a mouthpiece flavored by a flavoring liquid; and combining and packaging the smoking material portion, the first tube filter, and the mouthpiece with a wrapper, wherein the preparing comprises applying the moisturizing liquid by an amount of 0.3 mg to 1.0 mg per millimeter inside the first tube filter through a hollow of the first tube filter, and an amount of the moisturizing liquid applied inside the first tube filter is 10% to 200% of an amount of the flavoring liquid used in the mouthpiece.

According to some other embodiments, there is provided a smoking article, the smoking article comprising: a smoking material portion; a first tube filter located downstream of the smoking material portion and having a hollow formed therein; a mouthpiece located downstream of the first tube filter; and a wrapper covering the smoking material portion, the first tube filter, and the mouthpiece, wherein the first tube filter is a filter flavored by a first flavoring liquid or moisturized by a moisturizer, and the mouthpiece is a filter flavored by a second flavoring liquid.

The first tube filter may be a filter flavored by the first flavoring liquid, and a menthol content of the first tube filter may be higher than a menthol content of the mouthpiece.

In some embodiments, the smoking article may further comprise a cooling filter having an end contacting a downstream end of the first tube filter and having another end opposite the end, the other end contacting an upstream end of the mouthpiece, wherein the cooling filter comprises a polylactic acid fabric, a paper pipe, or a second tube filter.

In some other embodiments, the smoking article may further comprise a second tube filter having one end contacting a downstream end of the first tube filter and having another end opposite the end, the other end contacting an upstream end of the mouthpiece.

An inner diameter of the second tube filter may be greater than an inner diameter of the first tube filter, the first tube filter may be filter moisturized by the moisturizer, and the second tube filter may be a filter flavored by the first flavoring liquid.

Here, the first flavoring liquid and the second flavoring liquid may comprise 60% to 80% menthol and 20% to 40% propylene glycol (PG), and the moisturizer may comprise 70% to 90% glycerin and 10% to 30% PG.

In some embodiments, an amount of the first flavoring liquid applied to the second tube filter may be 6 mg to 9 mg.

An amount of the moisturizer of the first tube filter may be 7.5 mg to 9 mg.

MODE FOR INVENTION

Hereinafter, preferable embodiment will be described in detail with reference to the accompanying drawings. Advantages and features of the present disclosure, and methods of achieving the same will be clearly understood with reference to the following embodiments described in detail in conjunction with the accompanying drawings. However, the present disclosure is not limited to the embodiments set forth herein and may be embodied in various different forms. The embodiments are provided so that the disclosure will be thorough and complete, and will fully convey the scope of the disclosure to one of ordinary skill in the art, and the present disclosure is defined by the scope of the claims. Throughout the specification, same reference numerals denote same components.

Unless otherwise defined, all terms (including technical and scientific terms) used in the present specification may be used as meanings that may be commonly understood by one of ordinary skill in the art to which the present disclosure belongs. In addition, unless explicitly and specifically defined, terms defined in generally-used dictionaries are not ideally or excessively interpreted.

Furthermore, in the present specification, unless specifically mentioned in the context, singular forms may also include plural forms. "comprises" and/or "comprising" used in the specification does not exclude existence or addition of one or more other components, steps, operations and/or devices in addition to the mentioned components, steps, operations, and/or devices.

Terms including an ordinal number such as "first" or "second" used in the specification may be used to describe various components, but the components should not be limited by the terms. The terms are only used to distinguish one component from another component.

As used herein, expressions such as "at least one of," when preceding a list of elements, modify the entire list of elements and do not modify the individual elements of the list. For example, the expression, "at least one of a, b, and c," should be understood as including only a, only b, only c, both a and b, both a and c, both b and c, or all of a, b, and c.

It will be understood that when an element or layer is referred to as being "over," "above," "on," "connected to" or "coupled to" another element or layer, it can be directly over, above, on, connected or coupled to the other element or layer or intervening elements or layers may be present. In contrast, when an element is referred to as being "directly over,"

"directly above," "directly on," "directly connected to" or "directly coupled to" another element or layer, there are no intervening elements or layers present. Like numerals refer to like elements throughout.

Throughout the specification, "a smoking article" may indicate an article capable of generating aerosol, such as a cigarette, a cigar, and the like. A smoking article may include an aerosol generating material or an aerosol generating substrate. In addition, the smoking article may include a solid material based on tobacco materials such as reconstituted tobacco, pipe cut tobacco, and reconstituted tobacco. A smoking material may include a volatile compound.

In addition, throughout the specification, "upstream" or "an upstream direction" indicates a direction away from a mouth of the user puffing the smoking article, and "downstream" or "a downstream direction" indicates a direction toward the mouth of the user puffing the smoking article. For example, in a smoking article 100 shown in FIG. 1, a smoking material portion 110 is located at a downstream or a downstream direction of filters 120, 130, and 140.

Furthermore, in the present specification, a case in which a tube filter according to embodiments of the present disclosure is applied to a heating-type cigarette 2000 used together with an aerosol-generating device 1000 such as an electric tobacco device is described example, but it is not limited thereto, and the tube filter according to embodiments of the present disclosure may also be applied to a combustive-type cigarette.

Figure 2:
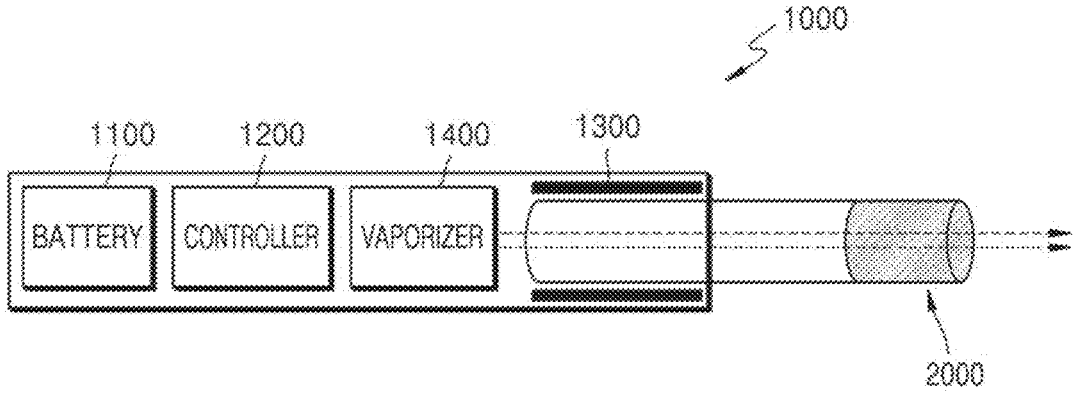
Figure 3:
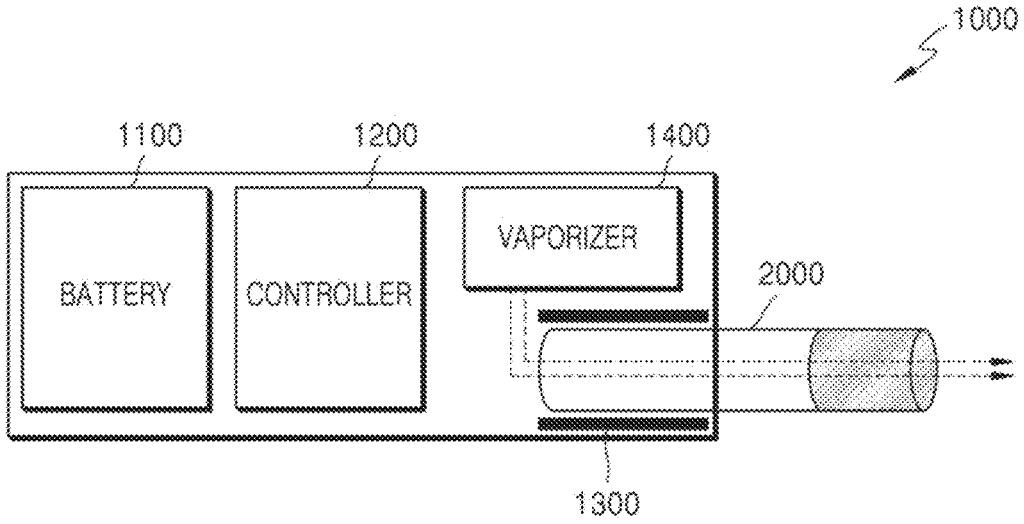

FIGS. 1 through 3 are diagrams showing examples in which a cigarette is inserted into an aerosol generating device.

Referring to FIG. 1, an aerosol generating device 1000 may include a battery 1100, a controller 1200, and a heater 1300. A cigarette 2000 may be inserted into an inner space of the aerosol generating device 1000. As illustrated in FIGS. 2 and 3, the aerosol generating device 1000 may further include a vaporizer 1400.

FIGS. 1 through 3 only illustrate some components of the aerosol generating device 1000, which are related to the relevant embodiments. Therefore, it will be understood by one of ordinary skill in the art related to the present embodiment that other general-purpose components may be further included in the aerosol generating device 1000, in addition to the components illustrated in FIGS. 1 through 3.

Also, FIGS. 2 and 3 illustrate that the aerosol generating device 1000 includes the heater 1300. However, the heater 1300 may be omitted according to embodiments.

FIG. 1 illustrates that the battery 1100, the controller 1200, and the heater 1300 are arranged in series. FIG. 2 also illustrates that the battery 1100, the controller 1200, the vaporizer 1400, and the heater 1300 are arranged in series. FIG. 3 illustrates that the vaporizer 1400 and the heater 1300 are arranged in parallel. However, the internal structure of the aerosol generating device 1000 is not limited to the structures illustrated in FIGS. 1 through 3. In other words, according to the design of the aerosol generating device 1000, the battery 1100, the controller 1200, the heater 1300, and the vaporizer 1400 may be differently arranged.

When the cigarette 2000 is inserted into the aerosol generating device 1000, the aerosol generating device 1000 may operate the heater 1300 and/or the vaporizer 1400 to generate aerosol from the cigarette 2000 and/or the vaporizer 1400. The aerosol generated by the heater 1300 and/or the vaporizer 1400 passes through the cigarette 2000 to be delivered to a user.

According to necessity, even when the cigarette 2000 is not inserted into the aerosol generating device 1000, the aerosol generating device 1000 may heat the heater 1300.

The battery 1100 may supply power to be used for the aerosol generating device 1000 to operate. For example, the battery 1100 may supply power to heat the heater 1300 or the vaporizer 1400, and may supply power for operation of the controller 1200. Also, the battery 1100 may supply power for operations of a display, a sensor, a motor, etc. (not illustrated) mounted in the aerosol generating device 1000.

The controller 1200 may generally control operations of the aerosol generating device 1000. In detail, the controller 1200 may control not only operations of the battery 1100, the heater 1300, and the vaporizer 1400, but also operations of other components included in the aerosol generating device 1000. Also, the controller 12000 may check a state of each of the components of the aerosol generating device 1000 to determine whether the aerosol generating device 1000 may be operated.

The controller 1200 may include at least one processor. A processor can be implemented as an array of a plurality of logic gates or can be implemented as a combination of a general-purpose microprocessor and a memory in which a program executable in the microprocessor is stored. It will be understood by one of ordinary skill in the art that the processor may be implemented in other forms of hardware.

The heater 1300 may be heated by power supplied from the battery 1100. For example, when the cigarette is inserted into the aerosol generating device 1000, the heater 1300 may be inserted into a portion in the cigarette 2000, and the heater 1300 that is heated may raise a temperature of an aerosol generating material in the cigarette 2000.

The heater 1300 may include an electro-resistive heater. For example, the heater 1300 may include an electrically conductive track, and the heater 1300 may be heated when currents flow through the electrically conductive track. However, the heater 1300 is not limited to the example described above and may include any heaters that may be heated to a desired temperature. Here, the desired temperature may be preset in the aerosol generating device 1000 or may be set as a temperature desired by a user.

As another example, the heater 1300 may include an induction heater. In detail, the heater 1300 may include an electrically conductive coil for heating the cigarette 2000 in an induction heating method, and the cigarette may include a susceptor which may be heated by the induction heater.

For example, the heater 13000 may include a tube-type heating element, a plate-type heating element, a needle-type heating element, or a rod-type heating element (not illustrated), and may heat the inside or the outside of the cigarette 2000, according to the shape of the heating element.

Also, the aerosol generating device 1000 may include a plurality of heaters 1300. Here, the plurality of heaters 1300 may be inserted into the cigarette 2000 or may be arranged outside the cigarette 2000. Also, some of the plurality of heaters 1300 may be inserted into the cigarette 2000 and the others may be arranged outside the cigarette 2000. In addition, the heater 1300 is not limited to the shapes illustrated in FIGS. 1 through 3, and may have various shapes.

The vaporizer 14000 may generate aerosol by heating a liquid composition and the generated aerosol may pass through the cigarette 2000 to be delivered to a user.

In other words, the aerosol generated by the vaporizer 1400 may move along an air flow passage of the aerosol generating device 1000, and the air flow passage may be configured such that the aerosol generated by the vaporizer 1400 passes through the cigarette 2000 to be delivered to the user.

For example, the vaporizer 1400 may include a liquid storage, a liquid delivery element, and a heating element, but it is not limited thereto. For example, the liquid storage, the liquid delivery element, and the heating element may be included in the aerosol generating device 1000 as independent modules.

The liquid storage may store a liquid composition. For example, the liquid composition may be a liquid including a tobacco-containing material having a volatile tobacco flavor component, or a liquid including a non-tobacco material. The liquid storage may be formed to be detachable from the vaporizer 1400 or may be formed integrally with the vaporizer 1400.

For example, the liquid composition may include water, a solvent, ethanol, plant extract, spices, flavorings, or a vitamin mixture. The spices may include menthol, peppermint, spearmint oil, and various fruit-flavored ingredients, but is not limited thereto. The flavorings may include ingredients capable of providing various flavors or tastes to a user.

Vitamin mixtures may be a mixture of at least one of vitamin A, vitamin B, vitamin C, and vitamin E, but are not limited thereto. Also, the liquid composition may include an aerosol forming substance, such as glycerin and propylene glycol.

The liquid delivery element may deliver the liquid composition of the liquid storage to the heating element. For example, the liquid delivery element may be a wick such as cotton fiber, ceramic fiber, glass fiber, or porous ceramic, but is not limited thereto.

The heating element is an element for heating the liquid composition delivered by the liquid delivery element. For example, the heating element may be a metal heating wire, a metal hot plate, a ceramic heater, or the like, but is not limited thereto. In addition, the heating element may include a conductive filament such as nichrome wire and may be positioned as being wound around the liquid delivery element.

The heating element may be heated by a current supply and may transfer heat to the liquid composition in contact with the heating element, thereby heating the liquid composition. As a result, aerosol may be generated.

For example, the vaporizer 1400 may be referred to as a cartomizer or an atomizer, but it is not limited thereto.

The aerosol generating device 1000 may further include general-purpose components in addition to the battery 1100, the controller 1200, the heater 1300, and the vaporizer 1400. For example, the aerosol generating device 1000 may include a display capable of outputting visual information and/or a motor for outputting haptic information. Also, the aerosol generating device 1000 may include at least one sensor (e.g., a puff detecting sensor, a temperature detecting sensor, a cigarette insertion detecting sensor, etc.). Also, the aerosol generating device 1000 may be formed as a structure where, even when the cigarette 2000 is inserted into the aerosol generating device 1000, external air may be introduced or internal air may be discharged.

Although not illustrated in FIGS. 1 through 3, the aerosol generating device 1000 and an additional cradle (not illustrated) may together form a system. For example, the cradle may be used to charge the battery 1100 of the aerosol generating device 1000. Alternatively, the heater 1300 may be heated when the cradle and the aerosol generating device 1000 are coupled to each other.

The cigarette 2000 may be similar to a general combustive cigarette. For example, the cigarette 2000 may be divided into a first portion including an aerosol generating material and a second portion including a filter, etc. Alternatively, the second portion of the cigarette 2000 may also include an aerosol generating material. For example, an aerosol generating material made in the form of granules or capsules may be inserted into the second portion.

The entire first portion may be inserted into the aerosol generating device 1000, and the second portion may be exposed to the outside. Alternatively, only a portion of the first portion may be inserted into the aerosol generating device 1000, or the entire first portion and a portion of the second portion may be inserted into the aerosol generating device 1000. The user may puff aerosol while holding the second portion by the mouth of the user. In this case, the aerosol is generated by the external air passing through the first portion, and the generated aerosol passes through the second portion and is delivered to the user's mouth.

For example, the external air may flow into at least one air passage formed in the aerosol generating device 1000. For example, the opening and closing of the air passage formed in the aerosol generating device 1000 and/or the size of the air passage may be adjusted by the user. Accordingly, the amount and quality of smoke (i.e., a mixture of aerosols and air) may be adjusted by the user. As another example, the external air may flow into the cigarette 2000 through at least one hole (not illustrated) formed in a surface of the cigarette 2000.

The cigarette 2000 may have various structures. For example, the cigarette 2000 may correspond to the smoking articles 100, 200, and 300 shown in FIGS. 4 through 6, but is not limited thereto. Hereinafter, the smoking articles 100, 200, and 300 will be described in detail with reference to FIGS. 4 through 6.

Figure 4:
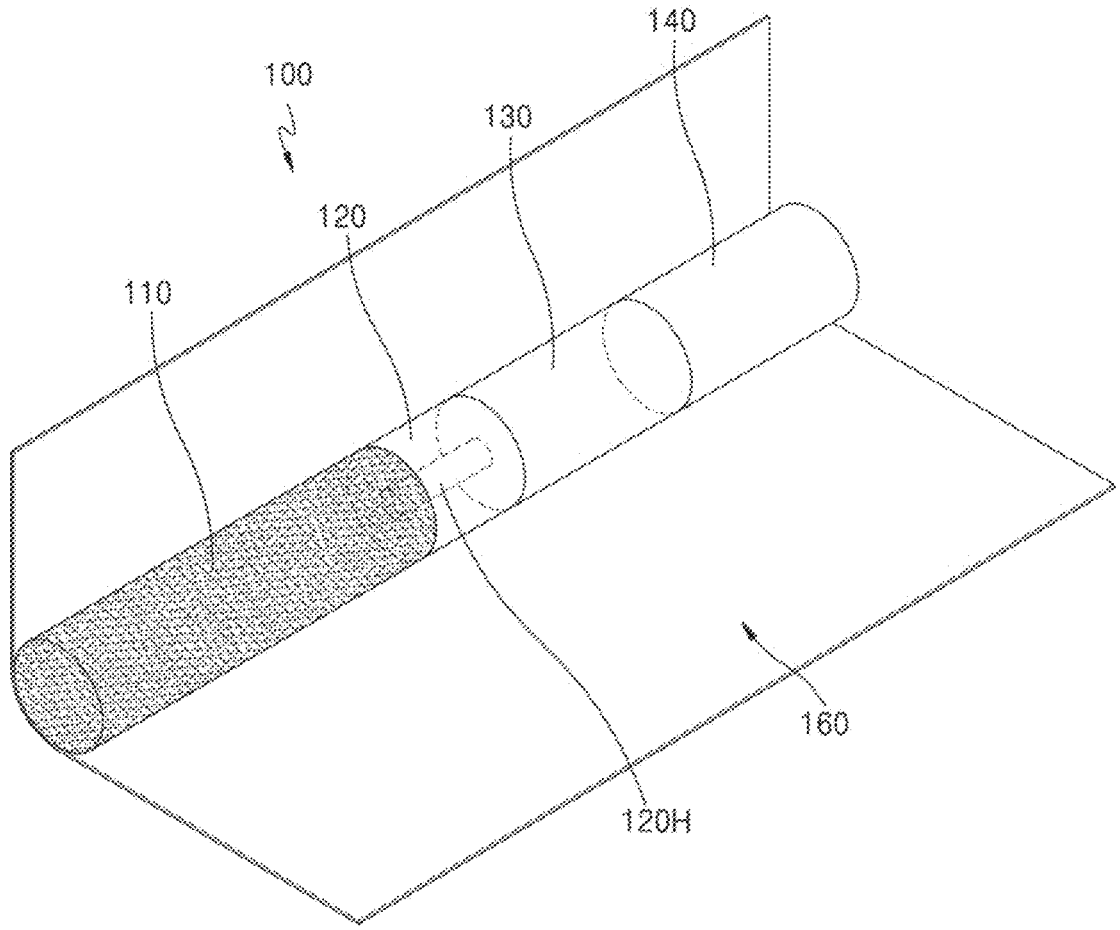
FIG. 4 is a diagram showing a schematic configuration of a smoking article according to an embodiment of the present disclosure.

FIG. 4 is a diagram showing a schematic configuration of a smoking article according to an embodiment of the present disclosure.

Referring to FIG. 4, a smoking article 1000 may comprise a smoking material portion 110, a first filter segment 120, a second filter segment 130, a third filter segment 140, and a wrapper 160. Although not illustrated, at least one of the smoking material portion 110, the first filter segment 120, the second filter segment 130, and the third filter segment 140 may be respectively packaged with separate wrappers before being packaged with the wrapper 160. For example, the smoking material portion 110 may be packaged with a smoking material wrapper (not illustrated), and at least one of the first filter segment 120, the second filter segment 130, and the third filter segment 140 may be packaged with a filter wrapper (not illustrated).

A diameter of the smoking article 1000 may be in a range of about 4 mm to about 9 mm, and a length of the smoking article 100 may be about 45 mm to about 50 mm, but embodiments are not limited thereto. For example, a length of the smoking material portion 110 may be about 12 mm, a length of the first filter segment 120 may be about 10 mm, a length of the second filter segment 130 may be about 14 mm, and a length of the third filter segment 140 may be about 12 mm. However, embodiments are not limited thereto.

The smoking material portion 110 includes an aerosol generating material that generates an aerosol when heated. For example, the aerosol generating material may include at least one of glycerin, propylene glycol, ethylene glycol, dipropylene glycol, diethylene glycol, triethylene glycol, tetraetylene glycol, and oleyl alcohol, but it is not limited thereto.

Also, the smoking material portion 110 may include other additives, such as flavors, a wetting agent, and/or organic acid. For example, the flavors may include licorice, sucrose, fructose syrup, isosweet, cocoa, lavender, cinnamon, cardamom, celery, fenugreek, cascarilla, white sandalwood, bergamot, geranium, honey essence, rose oil, vanilla, lemon oil, orange oil, mint oil, cinnamon, callaway, cognac, jasmine, camomille, menthol, cinnamon, ylang, salvia, spearmint, ginger, coriander, coffee, or the like. Also, the wetting agent may include glycerin, propylene glycol, or the like.

In some embodiments, the smoking material portion 110 may be filled with a reconstituted tobacco sheet. In some other embodiments, the smoking material portion 110 may be filled with a plurality of tobacco strands cut from the reconstituted tobacco sheet. The plurality of tobacco strands may be arranged in a same direction (i.e., parallel to each other) or in a random manner in the smoking material portion 110.

For example, the reconstituted tobacco sheet may be manufactured by the following process. First, tobacco raw materials are pulverized to produce a slurry in which aerosol materials (for example, glycerin, propylene glycol, and the like), flavoring liquid, a binder (for example, guar gum, xanthan gum, carboxymethyl cellulose (CMC), water, and the like are mixed. When producing the slurry, natural pulp or cellulose may be added, and one or more binders may be mixed together. A reconstituted tobacco sheet is formed by using the slurry, and tobacco strands may be produced by breaking or shredding a dried reconstituted sheet.

The tobacco raw materials may be tobacco leaf pieces, tobacco stems and/or tobacco fine powders produced during tobacco processing. The reconstituted tobacco sheet may include other additives such as lumber or cellulose fiber.

The aerosol generating material of about 5% to about 40 $ may be added to the slurry, and the aerosol generating material of about 2% to about 35% may remain in the reconstituted tobacco sheet. Preferably, the aerosol generating material of about 5% to about 30% may remain in the reconstituted tobacco sheet. Also, before a process of packaging the smoking material portion 110 with a smoking material wrapper, a flavoring liquid such as menthol or moisturizer may be sprayed in the middle of the smoking material portion 110.

The first filter segment 120 may be a tube-shape structure including a hollow 120H therein. A length of the first filter segment 120 may employ an appropriate length in a range about 4 mm to about 30 mm, but is not limited thereto. Preferably, the length of the first filter segment 120 may be about 10 mm, but is not limited thereto.

An external diameter of the first filter segment 120 may be about 3 mm to about 10 mm, for example, about 7 mm A diameter of the hollow 120H included in the first filter segment 120 may employ an appropriate diameter in a range from about 2 mm to about 4.5 mm, but is not limited thereto. Preferably, the diameter of the hollow 120H may be about 2.5 mm, about 3.4 mm, or about 4.2 mm, but is not limited thereto.

When manufacturing the first filter segment 120, the hardness of the first filter segment 120 may be adjusted by adjusting a content of a plasticizer.

The first filter segment 120 may also be manufactured by inserting structures such as a film or tube made of same or different materials into an internal portion (that is, the hollow 120H).

The first filter segment 120 may be manufactured by using cellulose acetate. By doing so, when the heater 130 is inserted, an internal material of the smoking material portion 110 may be prevented from being pushed back (that is, in a downstream direction), and a cooling effect of the aerosol may also be generated.

The first filter segment 120 according to some embodiments of the present disclosure may be an internally-flavored tube filter that is flavored through the internal portion (that is, the hollow 120H). In some other embodiments, the first filter segment 120 may be a tube filter moisturized through the hollow 120. In some embodiments, the first filter segment 120 may be a tube filter that is flavored and moisturized through the hollow 120 H. The first filter segment 120, which is flavored, will be described in detail later.

The second filter segment 130 may function as a cooling member configured to cool the aerosol that is generated when the smoking material portion 110 is heated by the heater 130. Accordingly, the user may puff the aerosol cooled to an appropriate temperature.

The second filter segment 130 may be manufactured by using an extrusion method or a fiber-weaving method. The second filter segment 130 may be manufactured in various shapes to increase a surface area per unit area (that is, the surface area contacting the aerosol).

In some embodiment, the second filter segment 130 may cool, by phase transition, the aerosol that is delivered from the smoking material portion 110. For example, materials for forming the second filter segment 130 may change its state by phase transition such as melting or glass transition that requires absorption of thermal energy. As this kind of endothermic reaction occurs at a temperature at which the aerosol enters the second filter segment 130, a temperature of the aerosol passing through the second filter segment 130 may decrease.

A length or diameter of the second filter segment 130 may be variously determined according to shapes of the smoking article 100. For example, a length of the second filter segment 130 may be appropriately employed in a range from about 7 mm to about 20 mm. Preferably, the length of the second filter segment 130 may be about 14 mm, but is not limited thereto.

The second filter segment 130 may be manufactured by weaving polymer fibers. In this case, the flavoring liquid may be applied to the fiber formed of polymer. Alternatively, the second filter segment 130 may be manufactured by weaving together a separate fiber coated with the flavoring liquid and a fiber made of polymer.

The second filter segment 130 may be manufactured by using a polymer material or biodegradable polymer material. For example, the polymer material may include gelatin, polyethylene (PE), polypropylene (PP), polyurethane (PU), fluorinated ethylene propylene (FEP), and a combination thereof, but is not limited thereto. Also, the biodegradable polymer material may include poly lactic acid (PLA), polyhydroxybutyrate (PHB), cellulose acetate, poly-epsilon-caprolacton (PCL), polyglycolic acid (PGA), polyhydroxyalkanoate (PHAs), and a starch-based thermoplastic resin, but is not limited thereto.

Preferably, the second filter segment 130 may be manufactured by only pure PLA. For example, the second filter segment 130 may have a three-dimensional structure shape manufactured by using one or more fiber strands made of pure PLA (hereinafter "fiber strand"). Here, a thickness and length of the fiber strand, the number of fiber strands included in the second filter segments, and shapes of the fiber strands may be various. As the second filter segment 130 is made of pure PLA, generation of specific substances may be prevented in a process in which the aerosol passes through the second filter segment 130.

A manufacturing process of the second filter segment 130 may include a process of wrapping the second filter segment 130 with a wrapper made of paper or polymer material. Here, the polymer material may include gelatin, polyethylene (PE), polypropylene (PP), polyurethane (PU), fluorinated ethylene propylene (FEP), and a combination thereof, but is not limited thereto.

As the second filter segment 130 is formed of woven polymer fiber or crimped polymer sheet, the second filter segment 130 may include one or more channels extending in a longitudinal direction. Here, a channel indicates a passage through which gas (for example, air and/or aerosols) passes.

For example, the second filter segment 130 including a crimp polymer sheet may be formed from a material having a thickness about 5 μm to about 300 μm, preferably about 10 IIM to about 250 μm. Also, a total surface area of the second filter segment 130 may be about 300 mm2/mm to about 1000 mm2/mm. In addition, an aerosol cooling element may be formed from a material having a specific surface area about 10 mm2/mg to about 100 mm2/mg.

In some embodiments, the second filter segment 130 may include a thread containing a volatile flavoring component. Here, the volatile flavoring component may be menthol, but is not limited thereto. For example, the thread may contain a sufficient amount of menthol to provide 1.5 mg or more menthol to the second filter segment 130.

The second filter segment 130 may be formed by rolling a porous paper sheet instead of the woven polymer fiber as described above. That is, a rolled porous paper sheet may be in the second filter segment 130 such that an air flow (for example, aerosols) may pass through in a longitudinal direction of the second filter segment 130.

In this case, the rolled porous paper sheet may be located in a cooling portion 700 while forming various patterns such that the air flow may pass in the longitudinal direction of the second filter segment 130. For example, an air flow passage of a honeycomb pattern, an air flow passage of an irregular pattern, an air flow passage of a vortex shape, or an air flow passage of concentric circles may be formed in the second filter segment 130.

The porous paper may include a material having elastic resilience and flexibility, and may be made of cellulose-based material used for a wrapper, such as birch and bamboo.

When the second filter segment 130 is formed of a porous paper sheet, a coating material including sucrose (for example, sucrose powder), distilled water, and starch syrup may be coated on the porous paper material. The starch syrup included in the coating material adjusts viscosity and suppresses precipitation of sugar/glucose crystals.

Materials included in the coating material are not limited to the above-described examples, and other materials may be added to improve efficiencies of a coating operation and drying operation of the second filter segment 130.

In an embodiment, relative to a total concentration of the coating material coated on the porous paper, a concentration of sucrose (for example, sucrose powder) is 30 wt % to 70 wt %, and a weight of the starch syrup relative to a total weight of the coating material may be 40% or less, but not limited thereto.

In other embodiments, the second filter segment 130 may be an edible film. The edible film may include a biodegradable film material. For example, starch, cellulose, and their derivatives, that is, pectin, alginate, carrageenan, and chitosan, and the like may be used as the biodegradable film material. In addition, pullulan having extraordinary abilities of coating and film-forming may be further added to the edible film. The second filter segment 130 of an edible-film type may be formed by mixing the above-described biodegradable film material and sucrose. In another embodiment, the second filter segment 130 of a sheet type may have a viscosity same as that of wax. To have the viscosity same as that of wax, the second filter segment 130 may include sucrose, acidic solution, and distilled water. The acidic solution may include lemon juice, vinegar, and the like.

The third filter segment 140, which is located at an end of a downstream of the smoking article 100, may function as a mouthpiece to finally deliver the aerosol, which is delivered from the upstream, to the user. In some embodiments, the third filter segment 140 may include a cellulose acetate filter. Although not illustrated, the third filter segment 140 may be manufactured as a recess filter.

A length of the third filter segment 140 may be appropriately employed in a range of about 4 mm to about 20 mm. For example, the length of the third filter segment 140 may be about 12 mm, but is not limited thereto.

In some embodiments, the third filter segment 140 may include at least one capsule (not illustrated). The capsule may be, for example, a spherical or cylindrical capsule formed by flavoring liquid covered by a coating film.

In a process of manufacturing the third filter segment 140, the third filter segment 140 may be manufactured to generate flavor by spraying the flavoring liquid thereon. Alternatively, a separate fiber coated with the flavoring liquid may be inserted into the third filter segment 140.

In some embodiments, an amount of the flavoring liquid inserted into the third filter segment 140 may be about 4 mg to about 9 mg.

The aerosol generated in the smoking material portion 110 is cooled as it passes through the second filter segment 130, and the cooled aerosol is delivered to the user through the third filter segment 140.

Therefore, when the flavoring liquid is added to the third filter segment 140, the flavor may be effectively delivered to the user.

However, if the flavoring liquid is added only to the third filter segment 140 as in the related arts, there is a limit in the amount of the flavoring liquid applicable in the manufacturing process due to external contamination through transfer of the flavoring liquid to the cigarette paper surrounding the outside of the filter. Also, as will be described later with reference to Table 5, menthol applied to the third filter segment 140 is transferred to an adjacent unflavored tube filter and the like over time, and thus, the amount of migration of menthol rapidly decreases during smoking.

For this reason, there have been attempts to perform flavoring treatment not only on the third filter segment 140 but also on the first filter segment 120. However, in a tube filter such as the first filter segment 120, in general, when the hardness of a filter is low during the manufacturing process, crack or crush occurs during cutting the filter. For this reason, unlike general mono filters, some tube filters are made by increasing a plasticizer content and instantaneously hardening it through high-temperature steam treatment at around 100° C. However, in this case, loss of flavor may occur due to high-temperature steam.

Thus, smoking articles according to embodiments of the present disclosure may include a first filter segment 120 that is manufactured by spraying flavor to the inside (i.e., a hollow) of the tube filter through an inner hole of a plastic rod of the tube filter forming apparatus. As a result, loss of flavor due to high-temperature steam may be minimized and the first filter segment 120 may be uniformly flavored.

The flavoring liquid injected into the first filter segment 120 may free-fall from a plastic rod nozzle 3100 of a tube filter forming apparatus to be described later with reference to FIG. 7. To increase hardness of the first filter segment 120, before the flavoring liquid is inserted into the first filter segment 120, steam with a high temperature and a high pressure is sprayed to the first filter segment 120 by a steam spray nozzle (not illustrated) of the tube filter forming apparatus. At this time, the plastic rod nozzle 3100 may be separate from the steam spray nozzle (not illustrated) of the tube filter forming apparatus by about 180 mm to about 350 mm in the longitudinal direction D1, and preferably, about 200 mm to about 300 mm.

In some embodiments, a menthol content applied to the first filter segment 120 may be about 25% to about 175% of a menthol content of the third filter segment 140. Preferably, the menthol content applied to the first filter segment 120 may be about 100% to about 150% of the menthol content of the third filter segment 140. In other words, a flavoring amount applied to the first filter segment 120 may be about 0.3 mg/mm to about 1.0 mg/mm (that is, about 0.3 mg to about 1.0 mg per 1 mm).

As described above, when the internal flavoring treatment is performed on the tube filter according to embodiments of the present disclosure, considering that a maximum amount of flavoring liquid that may be applied to the TJNS flavoring treatment method in the related arts is about 0.5 mg/mm to about 0.8 mg/mm, a maximum amount of flavoring liquid is about 1.2 times or two times larger than that in the TJNS flavoring treatment method.

In addition, when a cigarette of an internally-flavored tube filter according to the embodiments of the present disclosure is used, a loss rate of menthol applied to the mouthpiece (that is, the third filter segment 140) may be reduced, and at the same time, a menthol transfer amount to the cut tobacco filler portion (that is, the smoking material portion 110) may be increased, and therefore, taste of menthol may be enhanced during smoking.

Furthermore, since internal flavoring of the tube filter according to embodiments of the present disclosure causes free-fall of the flavoring liquid into the hollow of the tube filter, the flavoring liquid may be uniformly and sufficiently inserted into the tube without a complicated spray nozzle for spraying the flavoring liquid into the hollow of the tube. As a result, the manufacturing process may be simplified and manufacturing cost may be reduced.

Further details regarding the internally-flavored tube filter (that is, the first filter segment 120) will be described later with reference to FIG. 7.

The wrapper 160 may be a porous wrapper or non-porous wrapper. As an example, a thickness of the wrapper 160 may be about 40 μm to about 80 μm and an air porosity may be about 5 CU to about 50 CU, but embodiments are not limited thereto.

As described above, at least one of the smoking material portion 110, the first filter segment 120, the second filter segment 130, and the third filter segment 140 may be respectively packaged with separate wrappers before being packaged with the wrapper 160. For example, the smoking material portion 110 may be packaged with a smoking material wrapper (not illustrated), and the first filter segment 120, the second filter segment 130, and the third filter segment 140 may be respectively packaged with a first filter wrapper (not illustrated), a second filter wrapper (not illustrated), and a third filter wrapper (not illustrated), but a method by which the smoking article 100 and the components thereof are packaged with the wrappers is not limited thereto.

In some embodiments, the wrappers may have different physical properties depending on an area to be covered by each of the wrappers.

For example, the smoking material wrapper surrounding the smoking material portion 110 may have a thickness of about 61 μm and a porosity of about 15 CU, the first filter wrapper surrounding the first filter segment 120 may have a thickness of about 63 μm and a porosity of about 15 CU, but embodiments are not limited thereto. Also, inner surface(s) of the smoking material wrapper and/or the first filter wrapper may further include an aluminum foil.

The second filter wrapper surrounding the second filter segment 130 and the third filter wrapper surrounding the third filter segment 140 may be manufactured by using a hard wrapper. For example, the second filter wrapper may have a thickness of about 158 μm and a porosity of about 33 CU, and the third filter wrapper may have a thickness of about 155 μm and a porosity of about 46 CU, but embodiments are not limited thereto.

In some embodiments, a preset material may be added to the wrapper 160. Here, an example of the preset material may include silicon, but is not limited thereto. Silicon has certain characteristics such as heat resistance, oxidation resistance, resistance to various chemicals, water repellency, and electrical insulation. However, any other material having the above-described characteristics may be applied (or coated) on the wrapper 160 without limitation.

The wrapper 160 may prevent the smoking article 100 from burning. For example, when the smoking material portion 110 is heat via the heater described with reference to FIGS. 1 through 3, the smoking article 100 is likely to burn. More particularly, when a temperature increases to be equal to or higher than an ignition point of any one of materials included in the smoking material portion 110, the smoking article 100 may burn. However, the wrapper 160 includes an incombustible material, and therefore, burning of the smoking article 100 may be prevented.

In addition, the wrapper 160 may also prevent a holder of the aerosol-generating device 1000 (see FIG. 1) from being contaminated by materials generated in the smoking article 100. By puffs of the user, liquid materials may be generated in the smoking article 100. For example, as the aerosol generated in the smoking article 100 is cooled by external air, liquid materials (for example, moisture and the like) may be generated.

As the wrapper 160 packages the smoking material portion 110 and/or the first through third filter segments 120, 130, and 140, leakage of the liquid materials generated in the smoking article 100 to the outside of the smoking article 100 may be prevented. Therefore, contamination in the holder of the aerosol-generating device 1000 by the liquid materials generated in the smoking article 100 may be prevented.

Figure 5:
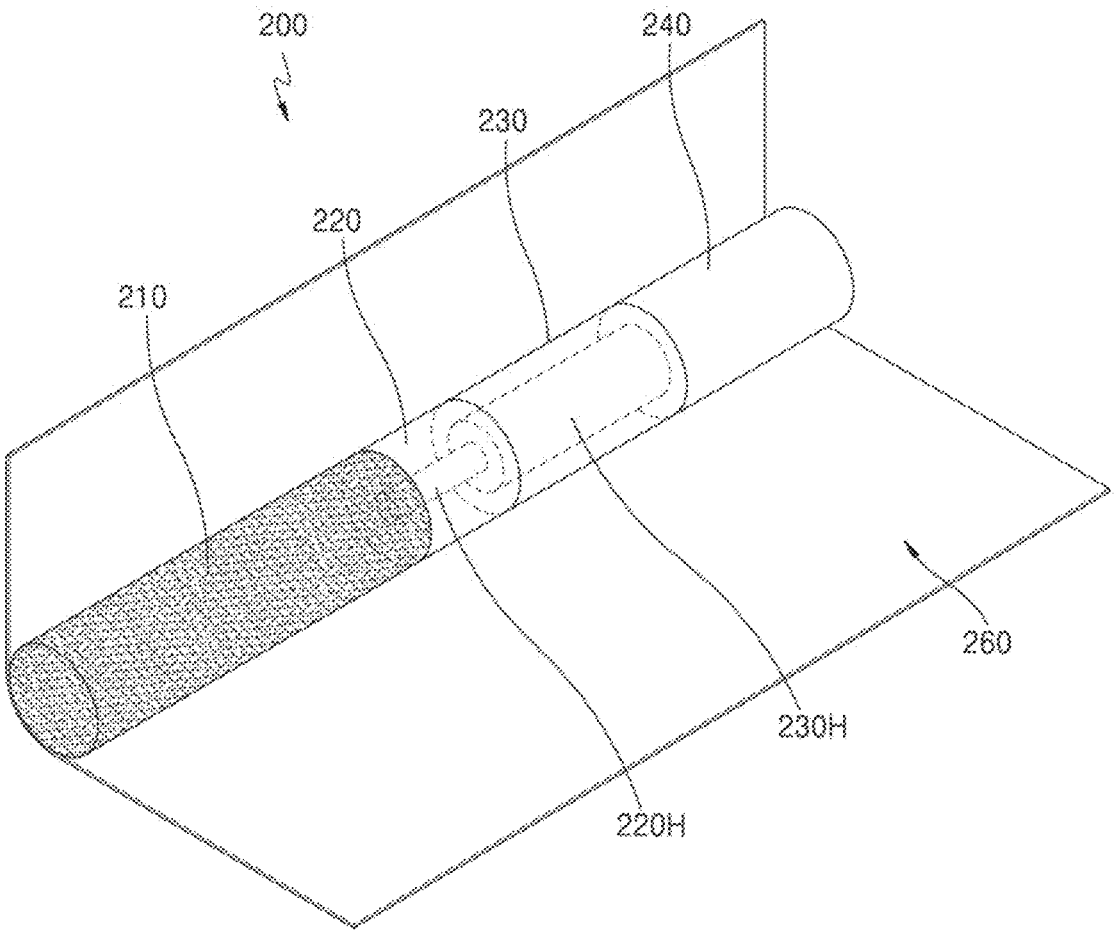
FIG. 5 is a diagram showing a schematic configuration of a smoking article according to another embodiment of the present disclosure.

FIG. 5 is a diagram showing a schematic configuration of a smoking article according to another embodiment of the present disclosure.

Referring to FIG. 5, a smoking article 200 may comprise a smoking material portion 210, a first filter segment 220, a second filter segment 230, a third filter segment 240, and a wrapper 260.

The smoking material portion 210, the first filter segment 220, the third filter segment 240, and the wrapper 260 of the smoking article 200 may have substantially same configurations as those of the smoking material portion 110, the first filter segment 120, the third filter segment 140, and the wrapper 160 described with reference to FIG. 4. Thus, for simplicity of explanation, duplicate descriptions will be omitted.

Unlike the second filter segment 130 described with reference to FIG. 4, the second filter segment 230 in the present embodiment may be a tube-shape structure including a hollow 230H therein, like the first filter segment 220. A shape of a cross-section of the hollow may include a polygon or circle, but a size and a shape of the hollow are not limited thereto.

The second filter segment 230 may adjoin the first filter segment 220 and may be at a downstream of the first filter segment 220.

A diameter (i.e., outer diameter) of the second filter segment 230 may be about 7 mm to about 9 mm, for example, about 7.9 mm A length (i.e., a dimension in the longitudinal direction of the smoking article 200) of the second filter segment 230 may be about 13 mm to about 15 mm, for example, about 14 mm. An inner diameter of the second filter segment 230 may be about 3.0 mm to about 5.5 mm, for example, about 4.2 mm.

In this case, the inner diameter of the second filter segment 230 may be greater than an inner diameter of the first filter segment 220. For example, the inner diameter of the first filter segment 220 may be about 2.5 mm, and the inner diameter of the second filter segment 230 may be about 4.2 mm.

As the inner diameter of the first filter segment 220 is smaller than the inner diameter of the second filter segment 230, main stream smoke (e.g., mixture of air and aerosols) exiting the 220H of the first filter segment 220 may expand in the hollow 230H of the second filter segment 230, which slows down the movement of the diffused main stream smoke in the downstream direction. As a result, a contact area and contact time between the main stream smoke and external air flowing into the second filter segment 230 may increase, and accordingly, a cooling effect of the main stream smoke may be improved.

The second filter segment 230 may include a material through which external gas may be introduced into the hollow 230H of the second filter segment 230, and the material may be formed of a mixture of a plurality of different materials. The material may be, for example, cellulose acetate tow.

In some embodiments, flavoring/moisturizing treatment may be applied to each of the first filter segment 220 and the second filter segment 230. For example, the first filter segment 220 may be an internally-flavored tube filter on which internal flavoring treatment has been performed, and the second filter segment 230 may be an internally-moisturized tube filter on which internal moisturizing treatment has been performed. Alternatively, the first filter segment 220 may be an internally-moisturized tube filter on which internal moisturizing treatment has been performed, and the second filter segment 230 may be an internally-flavored tube filter on which internal flavoring treatment has been performed. Alternatively, each of the first filter segment 220 and the second filter segment 230 may be an internally flavored and moisturized tube filter on which both internal flavoring treatment and internal moisturizing treatment have been performed.

Preferably, the first filter segment 220 may be an internally-moisturized tube filter on which internal moisturizing treatment has been performed, and the second filter segment 230 may be an internally-flavored tube filter on which internal flavoring treatment has been performed. That is, the tube-shape second filter segment 230 that is internally flavored may be located downstream of the tube-shape first filter segment 220 that is internally moisturized, and may be located upstream of the third filter segment 240 that is a TJNS filter.

As described, the internally-flavored tube filter is located between the internally-moisturized tube filter and the TJNS filter, and therefore, loss of flavor due to heat of the aerosol may be minimized.

For example, the first filter segment 220 and/or the second filter segment 230 may comprise a menthol flavor in an amount of about 25% to about 175% (for example, about 1.75 mg to about 12.25 mg in a case where the menthol content of the third filter segment 240 is 7 mg) of the menthol content (for example, 4 mg to 10 mg) of the third filter segment 240.

As another example, the first filter segment 220 and/or the second filter segment 230 may comprise moisturizer in an amount of about 25% to about 175% (for example, about 1.75 mg to about 12.25 mg in a case where the menthol content of the third filter segment 240 is 7 mg) of the menthol content (for example, 4 mg to 10 mg) of the third filter segment 240.

As another example, the first filter segment 220 and/or the second filter segment 230 may comprise menthol moisturizer in an amount of about 25% to about 175% (for example, about 1.75 mg to about 12.25 mg in a case where the menthol content of the third filter segment 240 is 7 mg) of the menthol content (for example, 4 mg to 10 mg) of the third filter segment 240. The menthol moisturizer may comprise, for example, menthol (e.g., 35% to 45%), PG (e.g., 5% to 15%), and glycerin (e.g., 45% to 55%).

Figure 6:
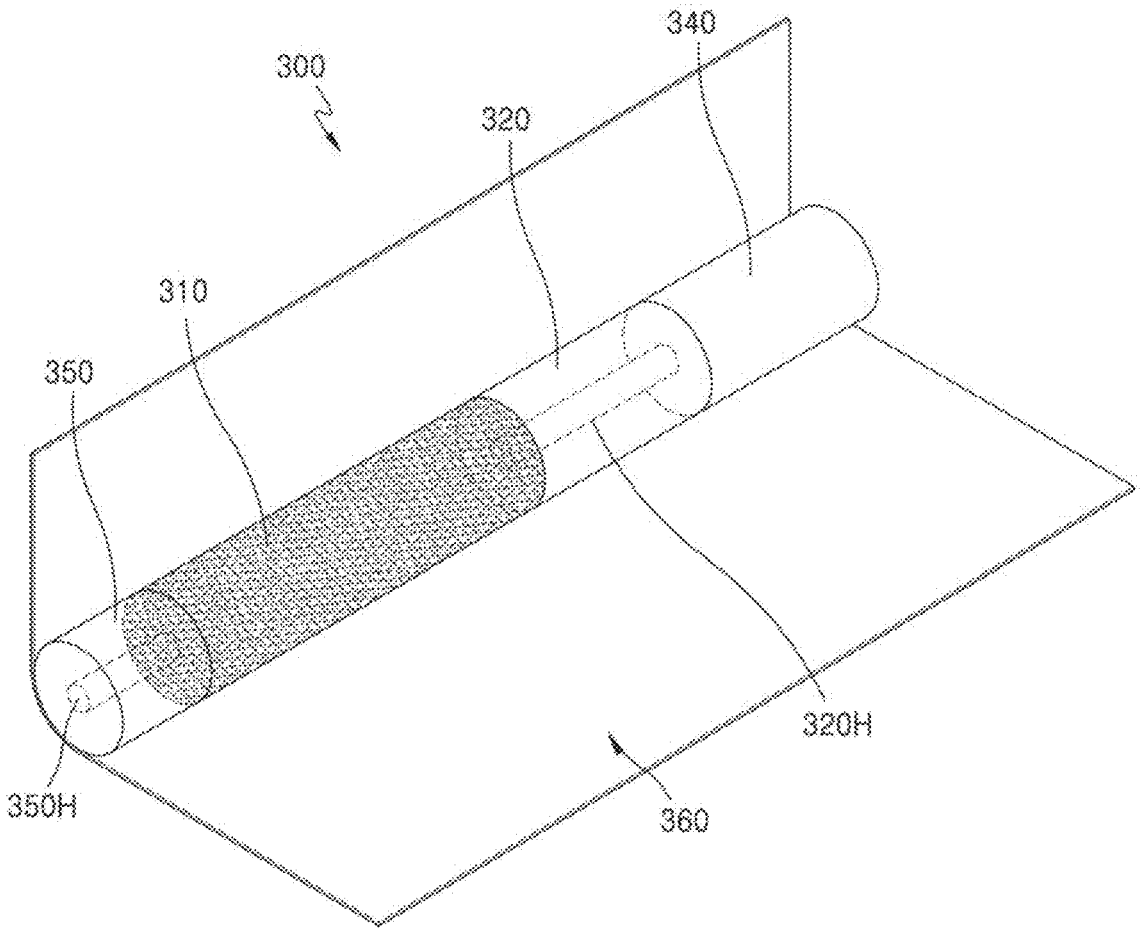
FIG. 6 is a diagram showing a schematic configuration of a smoking article according to another embodiment of the present disclosure.

FIG. 6 is a diagram showing a schematic configuration of a smoking article according to another embodiment of the present disclosure.

Referring to FIG. 6, a smoking article 300 may comprise a front-end filter segment 350, a smoking material portion 310, a first filter segment 320, a third filter segment 340, and a wrapper 360.

The smoking material portion 310, the first filter segment 320, the third filter segment 340, and the wrapper 360 of the smoking article may respectively and substantially have same configurations as those of the smoking material portion 110, the first filter segment 120, the third filter segment 140, and the wrapper 160. Thus, for simplicity of explanation, duplicate descriptions will be omitted.

Unlike the smoking articles 100 and 200 described with reference to FIGS. 4 and 5, the smoking article 300 may further comprise the front-end filter segment 350 adjoining the smoking material portion 310 at an upstream end of the smoking material portion 310.

The front-end filter segment 350 may prevent the smoking material portion 310 from being detached from the smoking article 300, and may also prevent the liquefied aerosol from flowing into the aerosol generating device 1000 (see FIGS. 1 through 3) during smoking. In addition, as the front-end filter segment 350 includes a channel, the aerosol entering the upstream end of the front-filter segment 350 may easily flow into the downstream end of the front-end filter segment 350, and thus, the user may easily puff the aerosol.

In some embodiments, the front-end filter segment 350 may be manufactured by using cellulose acetate. A mono denier of a filament included in the cellulose acetate tow may be included in a range of about 1.0 to about 10.0, and preferably, may be included in a range of about 3.0 to about 7.0 More preferably, the mono denier of the filament of the front-end filter segment 350 may be about 5.0. A total denier of the front-end filter segment 350 may be included in a range of about 25000 to about 350000, and preferably, may be included in a range of about 28000 to about 32000. More preferably, the total denier may be about 30000.

The front-end filter segment 350 may include a channel 350H extending from the upstream end to the downstream end. The channel 350H may be at the center of the front-end filter segment 350. For example, a center of the channel 350H may be identical to the center of the front-end filter segment 350.

Although FIG. 6 illustrates that a shape of a cross-section of the channel 350H is circular, the shape of the cross-section of the channel 350H is not limited thereto. For example, the shape of the cross-section of the channel 350H may include a three-leaf shape.

A surface area of the channel 350H may be in a range of about 5 mm2 to about 11 mm2 For example, the surface area of the channel 350H may be about 5.75 mm2, about 8.21 mm2, or about 10.89 mm2, but is not limited thereto.

A ratio of the cross-sectional area of the channel 350H to a total cross-sectional area based on an outer diameter of the front-end filter segment 350 may be in a range of about 14% to about 29%. For example, the ratio may be about 14.9%, about 21.3%, or about 28.3%, but is not limited thereto.

In some embodiments, the internal flavoring treatment and/or moisturizing treatment may be applied to the first filter segment 320. For example, the first filter segment 320 may be an internally-flavored tube filter, an internally-moisturized tube filter, or an internally-flavored and moisturized tube filter.

As an example, the first filter segment 320 may comprise menthol flavor (e.g., menthol flavoring liquid or menthol fragrance) that amounts to 25% to about 175% of a menthol content of the third filter segment 340. In some embodiment, the menthol flavor may comprise menthol in an amount of about 60% to about 80% (for example, 70%) and PG in an amount of about 20% to about 40% (for example, 30%).

As another example, the first filter segment 320 may comprise moisturizer that amounts to about 25% to about 175% of the menthol content of the third filter segment 340. In some embodiment, the menthol flavor may comprise 70% to about 90% (for example, 80%) glycerin and about 10% to about 30% (for example, 20%) PG.

As another example, the first filter segment 320 may comprise menthol moisturizer that amounts to about 25% to about 175% of the menthol content of the third filter segment 340. In some embodiments, the menthol moisturizer may comprise 35% to 45% (for example, 40%) menthol, 5% to 15% (for example, 10%) PG, and 45% to 55% (for example, 50%) glycerin.

Hereinafter, configurations of the present disclosure and effects thereof will be described in more detail with reference to embodiments and comparative examples. However, the embodiments are used to describe the present disclosure in more detail, and the scope of the present disclosure is not limited to the embodiments.

For clearer understanding of Embodiments 1 to 4 and Experimental Example 1 to be described later, FIGS. 7 and 8 and Table 1 will be referenced.

Figure 7:
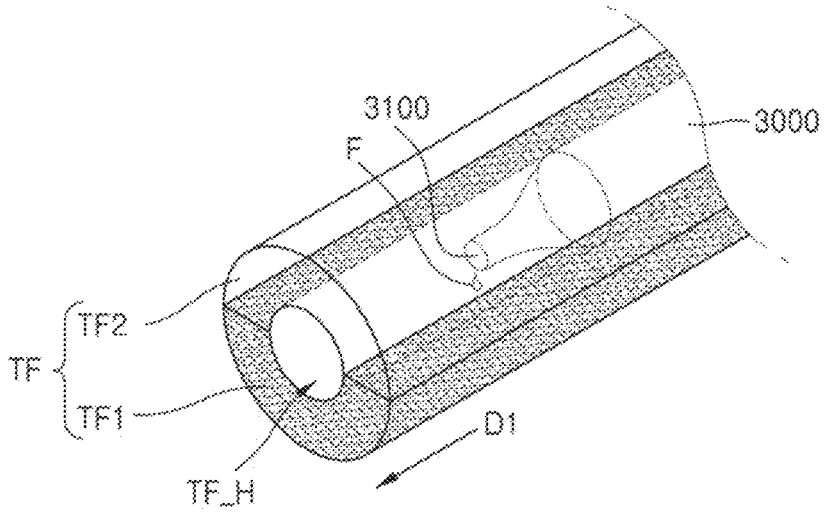
FIG. 7 illustrates a process of performing flavoring treatment on the inside of the tube filter, according to an embodiment of the present disclosure.

FIG. 7 illustrates a process of performing flavoring treatment on the inside of the tube filter according to embodiments of the present disclosure.

Shapes, structures, sizes and the like of a tubular rod TF shown in FIG. 7 and a plastic rod 3000 for forming a hollow TF_H in the tubular rod TF and performing flavoring treatment are shown in a simplified manner for clarity of explanation, and are not limited thereto.

In addition, for clarity of explanation, the tubular rod TF shown in FIG. 7 is divided in two regions, that is, a first region TF1 that is a lower half of the tubular rod and a second region TF2 that is an upper half of the tubular rod, but the first region and the second region are not physically divided. The tubular rod TF may be cut into a plurality of tube filters. Hereinafter, the tubular rod and the tube filter will be interchangeably used for description purposes.

Embodiment 1

By using the plastic rod 3000 of an apparatus (not illustrated) for forming the tube filter TF, flavoring treatment is performed on the inside (that is, the hollow TF_H) of the tube filter TF by using a flavoring liquid including a menthol content of about 70%.

In the present embodiment, a tube filter having an outer diameter of about 7.2 mm and an inner diameter of about 2.5 mm is used, and an amount of the flavoring liquid F inserted into the tube filter TF as the tube filter moves in the longitudinal direction D1 in the tube filter forming apparatus is about 0.1 mg/mm. The diameter of the plastic rod nozzle 3100 is about 0.9 mm.

Although not shown, before the flavoring liquid F is inserted into the tube filter TF, steam having a high temperature and high pressure may be sprayed by the steam spray nozzle (not illustrated) of the tube filter forming apparatus, and the plastic rod nozzle 3100 may be separated from the steam spray nozzle by about 200 mm in the longitudinal direction D1. A temperature of the steam may be about 80° C. to about 150° C.

The flavoring liquid F free-falls from the plastic rod 3000 of the tube filter forming apparatus, more particularly, from the plastic rod nozzle 3100 located at a tip portion of the plastic rod 3000, and is absorbed into a first region TF1 of the tube filter TF.

Embodiment 2

The tube filter TF is manufactured under same conditions as those of Embodiment 1, except that an amount of the flavoring liquid F inserted into the tube filter TF as the tube filter TF moves in the longitudinal direction D1 in the tube filter forming apparatus is about 0.3 mg/mm.

Embodiment 3

The tube filter TF is manufactured by using the plastic rod nozzle 3100 having a diameter of about 1.3 mm under same conditions as those of Embodiment 1, except that an amount of the flavoring liquid F inserted into the tube filter TF as the tube filter TF moves in the longitudinal direction D1 in the tube filter forming apparatus is about 1 mg/mm.

Embodiment 4

The tube filter TF is manufactured under same conditions as those of Embodiment 3, except that an amount of the flavoring liquid F inserted into the tube filter TF as the tube filter TF moves in the longitudinal direction D1 in the tube filter forming apparatus is about 1.2 mg/mm.

Experimental Example 1: Setting a Flavoring Amount (i.e., Amount of Flavoring Liquid) for Uniform Internal Flavoring of the Tube Filter To evaluate whether the tube filter is uniformly flavored, evaluation is performed on the tube filters that are manufactured by adjusting flavoring amounts according to Embodiments 1 to 4.

Figure 8:
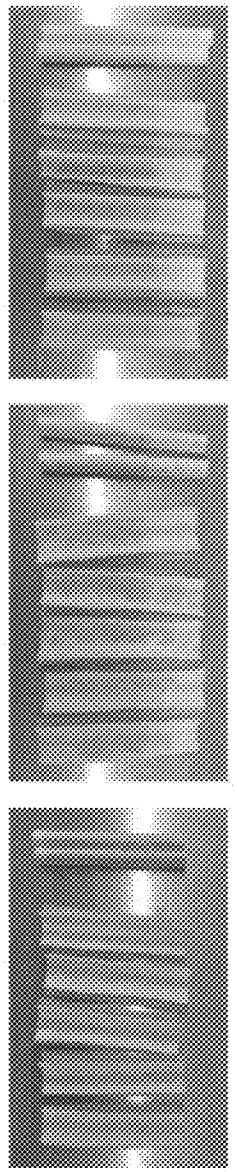
FIG. 8 shows photographs of a top half portion of a tube filter after flavoring treatment is performed on the inside of the tube filter.

FIG. 8 shows photographs of the second region TF2 (i.e., a top half portion opposite to the bottom half portion into which the flavoring liquid is directly applied by free-fall) to check whether the inside of the tube filter is uniformly flavored, and Table 1 shows the results regarding whether the flavoring is uniformly performed according to Embodiments 1 to 4.

TABLE 1

| classification | flavoring liquid (mg/mm) | remarks |
|---|---|---|
| Embodiment 1 | 0.1 | ununiformly flavored |
| Embodiment 2 | 0.3 | uniformly flavored |
| Embodiment 3 | 1 | uniformly flavored |
| Embodiment 4 | 1.2 | uniformly flavored/ wet cigarette paper |

As shown in Table 1 and (a) of FIG. 8, the flavor is cut off in the tube filter of Embodiment 1 where the flavoring amount is 0.1 mg/mm, and therefore, it is found that flavoring is not uniformly performed in the tube filter. As shown in (b) of FIG. 8, the flavor is not cut off in the tube filter of Embodiment 2. In the tube filter of Embodiment 3 shown in (c) of FIG. 8, it is found that the flavor is not cut off and the flavoring liquid is more uniformly applied in the tube filter. Although it is found that the tube filter of Embodiment 4 is also uniformly flavored, as the flavoring liquid used for internal flavoring is excessively diffused to the outer surface of the tube filter, a cigarette paper covering the tube filter is wet. Accordingly, it is found that the flavoring characteristic was excellent when the flavoring amount of the tube filter was 0.3 mg/mm to 1.0 mg/mm.

Meanwhile, unlike in Embodiments 1 to 4, in an experiment where the diameter of the plastic rod nozzle 3100 is 0.7 mm and the flavoring amount is about 0.3 mg/mm to about 1.0 mg/mm, nozzle-imperforation occurs due to occurrence of menthol crystallization, and therefore, the experiment is excluded from the Table 1. In addition, in an experiment in which the diameter of the plastic rod nozzle 3100 is 1.3 mm and the flavoring amount is about 0.1 mg/mm to about 0.6 mg/mm, the flavoring liquid does not uniformly fall, and therefore, the experiment is excluded from the Table 1.

From the above-described results, it is found that a uniform flavoring characteristic is most excellent in a case where the flavoring amount applied to the inside of the tube filter is 0.3 mg/mm to 1.0 mg/mm. More preferably, it is most advantageous in resolving issue of occurrence of menthol crystallization and securing uniform flavoring to apply a flavoring amount in a range of 0.3 mg/mm to 0.6 mg/mm through the plastic rod nozzle 3100 having a diameter of 0.8 mm to 1.1 mm or to apply a flavoring amount in a range of 0.7 mg/mm to 1.0 mg/mm through the plastic rod nozzle 3100 having a diameter of about 1.2 mm to 1.4 mm.

Embodiment 5

The tube filter of Embodiment 2, in which the amount of flavoring liquid is about 0.3 mg/mm, was stored for about twenty four hours after manufacture, and the tube filter was cut into the first region TF1 and the second region TF2.

Embodiment 6

A tube filter is manufactured and cut under same conditions as those of Embodiment 5, except that an amount of the flavoring liquid is about 0.6 mg/mm.

Experimental Example 2: Evaluation on Diffusion of Flavoring in the Tube Filter

To check whether the flavoring is diffused in the tube filter, menthol contents in cut-off tube regions in Embodiments 5 and 6 are analyzed and shown in Table 2.

TABLE 2

| | first region (TF1) | | second region (TF2) | | total of the first/second regions | |
|---|---|---|---|---|---|---|
| classification | content (mg) | proportion (%) | content (mg) | proportion (%) | content (mg) | proportion (%) |
| Embodiment 5 | 2.6 | 55.5 | 2.1 | 44.5 | 4.70 | 100 |
| Embodiment 6 | 6.0 | 54.4 | 5.02 | 45.6 | 11.02 | 100 |

As shown in Table 2, it is found that menthol included in the flavoring liquid inserted into the hole in the first region TF1 is diffused to the entire tube filter. In detail, the menthol content in the second region TF2 may be about 70% to about 95% of the menthol content in the first region TF1. Preferably, the menthol content in the second region TF2 may be about 80% to about 85% of the menthol content in the first region TF1.

Comparative Example 1

A heating-type cigarette having a same structure as the smoking article 300 shown in FIG. 6 is used. That is, the heating-type cigarette includes a front-end plug, a medium portion (i.e., smoking material portion 310), a tube filter, and a mouthpiece.

The above-described internal flavoring process is not performed on a 12 mm-long tube filter, and a 14 mm-long transfer jet nozzle system (TJNS) filter on which 7 mg of menthol has been sprayed is used as a mouthpiece.

Embodiment 7

A heating-type cigarette is manufactured under same conditions as those of Comparative Example 1, except using a 12 mm-long tube filter on which internal flavoring treatment has been performed by using 1.75 mg (that is, about 25% of the menthol flavor content of the TJNS filter) of menthol flavor. An amount of the flavoring liquid applied in the manufacturing of the tube filter is about 0.15 mg/mm.

Embodiment 8

A heating-type cigarette is manufactured under same conditions as those of Comparative Example 1, except using a 12 mm-long tube filter on which internal flavoring treatment is performed by using 3.50 mg (that is, about 50% of the menthol flavor content of the TJNS filter) of menthol flavor. An amount of the flavoring liquid applied in the manufacturing of the tube filter is about 0.3 mg/mm.

Embodiment 9

A heating-type cigarette is manufactured under same conditions as those of Comparative Example 1, except using a 12 mm-long tube filter on which internal flavoring treatment is performed by using 7.00 mg (that is, about 100% of the menthol flavor content of the TJNS filter) of the menthol flavor. An amount of the flavoring liquid applied in the manufacturing of the tube filter is about 0.58 mg/mm.

Embodiment 10

A heating-type cigarette is manufactured under same conditions as those of Comparative Example 1, except using a 12 mm-long tube filter on which internal flavoring treatment is performed by using 10.50 mg (that is, about 150% of the menthol flavor content of the TJNS filter) of menthol flavor. An amount of the flavoring liquid applied in the manufacturing of the tube filter is about 0.88 mg/mm.

Experimental Example: Evaluation on Physical Properties of a Cigarette to which the Internally-Flavored Tube Filter is Applied To examine changes in the physical properties of a cigarette according to internal flavoring treatment of the tube filter, weights, draw resistance, circumferences, circularities, and dilution rates of the cigarettes in the above-described Comparative Example 1 and Embodiments 7 through 10 are analyzed and shown in Table 3.

TABLE 3

| classification | flavoring liquid mg (%) | weight (mg) | draw resistance ($mmH_2O$) | circumference (mm) | circularity (%) | dilution ratio (%) |
|---|---|---|---|---|---|---|
| Comparative Example 1 | non-flavored | 658.3 | 46.5 | 22.71 | 94.8 | 15.4 |
| Embodiment 7 | 1.75 (25%) | 669.3 | 49.1 | 22.74 | 94.4 | 16.5 |
| Embodiment 8 | 3.50 (50%) | 667.1 | 49.3 | 22.75 | 94.1 | 17.0 |
| Embodiment 9 | 7.00 (100%) | 669.1 | 49.0 | 22.75 | 94.0 | 16.6 |
| Embodiment 10 | 10.50 (150%) | 671.3 | 48.7 | 22.75 | 94.1 | 16.1 |

As shown in Table 3, there is tendency that the weight and draw resistance of the cigarette slightly increase in proportion to the amount of the flavoring liquid, but the physical properties meet the standard of mass production with little differences from the Comparative Example 1 in which flavoring treatment is not performed.

Experimental Embodiment 4: Analysis on Smoke Components of the Cigarettes to which the Internally-Flavored Tube Filters are Applied To analyze smoke components of the cigarette to which the internally-flavored tube filter is applied, smoke components of main stream smoke are analyzed during smoking of the cigarettes in Comparative Example 1 and Embodiments 7 through 10 after two weeks from manufacture. Smoke collection for component analysis is repeated three times for each sample, and a component analysis result based on a mean value for three times of collection results is shown in Table 4. The cigarettes are tested according to Health Canada (HC) smoking condition by using an automatic smoking device in a smoking room in which a temperature is about 20° C. and moisture is about 62.5%.

TABLE 4

| classification | TPM (mg) | Tar (mg) | Nicotine (mg) | PG (mg) | Glycerin (mg) | moisture (mg) | menthol (mg) |
|---|---|---|---|---|---|---|---|
| Comparative Example 1 | 51.6 | 24.0 | 0.74 | 2.25 | 8.89 | 26.91 | 1.47 |
| Embodiment 7 | 52.4 | 23.8 | 0.76 | 2.37 | 9.29 | 27.8 | 1.50 |
| Embodiment 8 | 52.0 | 23.8 | 0.74 | 2.35 | 9.35 | 27.4 | 1.65 |
| Embodiment 9 | 50.5 | 21.9 | 0.68 | 2.09 | 8.59 | 27.9 | 1.90 |
| Embodiment 10 | 53.1 | 22.6 | 0.71 | 2.19 | 8.77 | 29.7 | 2.04 |

As shown in Table 4, it is found that amounts of the components except the menthol content did not show significant differences from Comparative Example 1 and Embodiments 7 through 10, but on the other hand, an amount of migration of menthol linearly increased according to increase in the flavoring amount of the tube filter included in the cigarette of each embodiment.

Experimental Example 5: Analysis on a Migration Pattern of Menthol Flavor During Storage of the Cigarette To check a migration pattern of the menthol flavor during storage preservation according to application of the internal flavoring of the tube filter, menthol contents of respective segments of the cigarette are analyzed over time.

TABLE 5

| classification | passage of time | mouthpiece (mg) | tube filter (mg) | wrapping paper (mg) | cut tobacco filler (mg) |
|---|---|---|---|---|---|
| Comparative Example 1 | A day | 2.64 | 1.00 | 0.52 | 0.49 |
| | Two weeks | 2.21 | 1.81 | 0.39 | 1.04 |
| | Four weeks | 1.90 | 1.87 | 0.38 | 1.31 |
| Embodiment 7 | A day | 2.56 | 1.35 | 0.52 | 0.58 |
| | Two weeks | 2.28 | 1.99 | 0.45 | 1.20 |
| | Four weeks | 1.84 | 2.06 | 0.38 | 1.56 |
| Embodiment 8 | A day | 2.94 | 2.10 | 0.68 | 0.81 |
| | Two weeks | 2.44 | 2.42 | 0.49 | 1.46 |
| | Four weeks | 2.09 | 2.42 | 0.43 | 1.78 |
| Embodiment 9 | A day | 2.76 | 2.85 | 0.77 | 0.82 |
| | Two weeks | 2.75 | 2.93 | 0.59 | 1.82 |
| | Four weeks | 2.49 | 2.92 | 0.55 | 2.22 |
| Embodiment 10 | A day | 2.903 | 3.89 | 1.18 | 1.06 |
| | Two weeks | 2.93 | 3.80 | 0.98 | 2.31 |
| | Four weeks | 3.11 | 3.81 | 0.91 | 2.30 |

As shown in Table 5, in Comparative Example 1 and the Embodiments, it is found that menthol in the cigarette tend to move from a segment having a high content to a segment having a low content. For example, although the tube filter in the Comparative Example 1 is not flavored during the manufacturing, but menthol of 1.00 mg is detected from the tube filter after a day from the manufacturing, which is presumed to have been transferred from the mouthpiece portion (the TJNS filter). Menthol contents in the mouthpiece portions of the cigarettes after a day from the manufacturing did not show significant differences between Comparative Example 1 and the Embodiments. However, a menthol content in the mouthpiece portion measured four weeks after manufacture in the Comparative Example 1 shows a loss rate that mounts to about 28% (that is, decreased from 2.64 mg to 1.90 mg) of the menthol content measured one day after manufacture. It is presumed that most of the decreased menthol is transferred toward the tube filter. When a menthol loss amount in the mouthpiece portion increases as shown in Comparative Example 1, this causes decrease in an amount of migration of menthol into the main stream smoke and degradation in menthol taste during smoking.

Unlike Comparative Example 1, in Embodiments 7 through 10 in which the internally-flavored tube filter is applied, it is found that a loss rate of menthol applied to the mouthpiece decreased.

Particularly, in Embodiment 9 in which menthol of a same amount as the menthol content in the mouthpiece (that is, 100% compared to a menthol content in the mouthpiece) is internally flavored in the tube filter, it is found that the loss rate of the menthol content in the mouthpiece rapidly decreased to about 9% (that is, decreased from 2.76 mg to 2.49 mg) despite in the same storage period.

Furthermore, in Embodiment 10 in which a larger amount of menthol than the menthol content in the mouthpiece (that is, 150% of the menthol content in the mouthpiece) is used to internally-flavor the tube filter, it is found that the menthol content in the mouthpiece rather increased by about 7% (from 2.90 mg to 3.11 mg).

Meanwhile, it is found that the menthol included in the mouthpiece and/or the tube filter is also transferred to the cut tobacco filler portion (i.e., smoking material portion) over time. An amount of menthol transferred to the cut tobacco filler portion linearly increased according to increase in the flavoring amount of the tube filter. In detail, after four weeks from the manufacture, a menthol content in the cut tobacco filler portion in Comparative Example 1 is about 1.31 mg, a menthol content in the cut tobacco filler portion in Embodiment 7 is about 1.78 mg, a menthol content in the cut tobacco filler portion in Embodiment 8 is about 1.78 mg, a menthol content in Embodiment 9 after four weeks from manufacture is about 2.22 mg, and a menthol content in Embodiment 10 after four weeks from manufacture is about 2.30 mg.

Considering that the menthol residual in the mouthpiece and the menthol transferred to the cut tobacco filler portion may help increase an amount of migration of menthol during smoking, it is expected that the cigarettes in Embodiments 7 through 10, preferably Embodiments 9 through 10, provide high flavor intensity and high flavor satisfaction during smoking.

Experimental Example 6: Analysis on Amounts of Migration of Menthol During Smoking of Cigarettes to which Internally-Flavored Tube Filters are Applied To confirm whether the amount of migration of menthol is increased as expected in Experimental Example 5, amounts of migration of menthol during smoking of the cigarettes in Comparative Example 1 and Embodiments 7 through 10 after two weeks and four weeks from manufacture are analyzed and shown in Table 6

TABLE 6

| classification | passage of time | amount of migration of menthol | increase rate compared to Comparative Example 1 (%) |
|---|---|---|---|
| Comparative Example 1 | Two weeks | 1.47 | — |
| | Four weeks | 1.20 | — |
| Embodiment 7 | Two weeks | 1.50 | 2.0 |
| | Four weeks | 1.29 | 7.5 |

TABLE 6-continued

| classification | passage of time | amount of migration of menthol | increase rate compared to Comparative Example 1 (%) |
|---|---|---|---|
| Embodiment 8 | Two weeks | 1.65 | 12.2 |
| | Four weeks | 1.47 | 22.5 |
| Embodiment 9 | Two weeks | 1.90 | 29.3 |
| | Four weeks | 1.70 | 41.7 |
| Embodiment 10 | Two weeks | 2.03 | 38.1 |
| | Four weeks | 2.01 | 67.5 |

As shown in Table 6, the amount of migration of menthol in all of Embodiments 7 through 10 increased than that of Comparative Example 1, and it is found that the difference becomes more significant over time.

Accordingly, in the cigarette in which the internally-flavored tube filter is applied as in Embodiments 7 to 10, it is found that the amount of migration of menthol did not simply increase according to increase in the flavoring amount applied to the cigarette, but the amount of migration of menthol was stably secured over time. Particularly, in Embodiment 10 employing a tube filter on which internal flavoring treatment has been performed by using menthol of about 150% of the menthol content in the mouthpiece, it is found that the difference in the amount of migration of menthol between two weeks and four weeks after manufacture has significantly decreased. As a result, the increase in the amount of migration of menthol compared to Comparative Example 1 is 67.5%, which is significantly higher than those of other Embodiments.

Comparative Example 2

A heating-type cigarette having a same structure as that of the smoking article 200 shown in FIG. 5 is used. That is, the heating-type cigarette includes a medium portion, a tube filter, a cooling filter, and a mouthpiece.

The above-described internal flavoring process is not performed on the tube filter having a length of 10 mm, and a 12 mm-long transfer jet nozzle system (TJNS) filter having been sprayed 7 mg of menthol flavor is used as the mouthpiece.

Embodiment 11

A heating-type cigarette is manufactured under same conditions as those of Comparative Example 2, except using a 10 mm-long tube on which internal flavoring treatment has been performed by using 4.5 mg (that is, about 75% of the menthol flavor content of the TJNS filter) of menthol flavor. An amount of the flavoring liquid applied in the manufacturing of the tube filter is about 0.45 mg/mm.

Embodiment 12

A heating-type cigarette is manufactured under same conditions as those of Comparative Example 2, except using a 10 mm-long tube filter on which internal flavoring treatment has been performed by using 6.0 mg (that is, about 100% of the menthol flavor content of the TJNS filter) of menthol flavor. An amount of the flavoring liquid applied in the manufacturing of the tube filter is about 0.6 mg/mm.

Embodiment 13

A heating-type cigarette is manufactured under same conditions as those of Comparative Example 2, except using a 10 mm-long tube on which internal flavoring treatment has been performed by using 7.5 mg (that is, about 125% of the menthol flavor content of the TJNS filter) of menthol flavor. An amount of the flavoring liquid applied in the manufacturing of the tube filter is about 0.75 mg/mm.

Embodiment 14

A heating-type cigarette is manufactured under same conditions as those of Comparative Example 2, except using a 10 mm-long tube filter on which internal flavoring treatment has been performed by using 9.0 mg (that is, about 150% of the menthol flavor content of the TJNS filter) of menthol flavor. An amount of the flavoring liquid applied in the manufacturing of the tube filter is about 0.9 mg/mm.

Embodiment 15

A heating-type cigarette is manufactured under same conditions as those of Comparative Example 2, except using a 10 mm-long tube on which internal flavoring treatment is performed by using 10.5 mg (that is, about 175% of the menthol flavor content of the TJNS filter) of the menthol flavor. An amount of the flavoring liquid applied in the manufacturing of the tube filter is about 1.05 mg/mm.

Experimental Example 7: Evaluation on Physical Properties of a Cigarette to which the Internally-Flavored Tube Filter is Applied To examine changes in the physical properties of a cigarette according to internal flavoring treatment of the tube filter, weights, draw resistance, circumferences, circularities, and dilution rates of the cigarettes according to Comparative Example 2 and Embodiments 11 through 15 are analyzed and shown in FIGS. 7 and 8.

TABLE 7

| classification | flavoring liquid mg (%) | weight (mg) | draw resistance ($mmH_2O$) | circumference (mm) | circularity (%) | rigidity (%) |
|---|---|---|---|---|---|---|
| Comparative Example 2 | non-flavored | 679.5 | 6.1 | 22.78 | 97.1 | 95.0 |
| Embodiment 11 | 4.5 (75%) | 683.1 | 6.1 | 22.78 | 97.3 | 94.6 |
| Embodiment 12 | 6.0 (100%) | 694.9 | 6.2 | 22.79 | 96.6 | 94.0 |

TABLE 7-continued

| classification | flavoring liquid mg (%) | weight (mg) | draw resistance ($mmH_2O$) | circumference (mm) | circularity (%) | rigidity (%) |
|---|---|---|---|---|---|---|
| Embodiment 13 | 7.5 (125%) | 703.8 | 6.9 | 22.86 | 96.3 | 96.3 |
| Embodiment 14 | 9.0 (150%) | 716.6 | 7.0 | 22.88 | 96.5 | 96.5 |
| Embodiment 15 | 10.5 (175%) | 733.6 | 7.2 | 22.87 | 96.3 | 96.3 |

TABLE 8

| | Embodiment 11 | | | | | Embodiment 12 | | | | |
|---|---|---|---|---|---|---|---|---|---|---|
| classification | 0 day | One day | Three days | Fifteen days | Thirty days | 0 day | One day | Three days | Fifteen days | Thirty days |
| circumference | 22.70 | 22.60 | 22.58 | 22.58 | 22.58 | 22.72 | 22.70 | 22.69 | 22.69 | 22.69 |
| inner diameter | 3.27 | 3.26 | 3.24 | 3.24 | 3.25 | 3.26 | 3.25 | 3.25 | 3.26 | 3.25 |

As shown in Tables 7 and 8, there is tendency that the weight and draw resistance of the cigarettes slightly increase in proportion to the amount of the flavoring liquid, but the physical properties meet the standard of mass production with little differences from the Comparative Example 2 where the cigarette is not flavored.

Comparative Example 3

An amount of the flavoring liquid inserted while manufacturing the tube filter is about 36 mg/80 mm (that is, about 0.45 mg/mm). A menthol content in the flavoring liquid is about 70%, and a propylene glycol (PG) content is about 30%. The flavoring treatment was performed at a position apart from the steam spray nozzle by about 50 mm in the longitudinal direction D1 (see FIG. 7).

Comparative Example 4

Flavoring treatment was performed under same conditions as those of Comparative Example 3, except that the flavoring treatment is performed at a position apart by about 100 mm from the steam spray nozzle.

Comparative Example 5

Flavoring treatment was performed under same conditions as those of Embodiment 11, except that the flavoring treatment was performed at a position apart by about 150 mm from the steam spray nozzle.

Embodiment 11

*273Flavoring treatment is performed under same conditions as those of Comparative Example 3, except that the flavoring treatment is performed at a position apart by about 200 mm from the steam spray nozzle.

Comparative Example 6

Flavoring treatment is performed under same conditions as those of Embodiment 11, except that the flavoring treatment is performed at a position apart by about 400 mm from the steam spray nozzle.

Experimental Example 8: Analysis on a Loss Rate of Flavor During Internal Flavoring Treatment on the Tube Filter To check a loss rate of flavor in an internal flavoring process of the tube filter, menthol contents input during the manufacturing of the tube filter and menthol contents included in the manufactured tube filters are analyzed and shown in Table 9 and Table 10.

TABLE 9

| classification | flavoring liquid (mg/80 mm) | menthol input amount (mg/80 mm) | menthol content in tube filter (mg/80 mm) | menthol input/ output (%) |
|---|---|---|---|---|
| Embodiment 11 | 36 (75%) | 25.2 | 24.1 | 95.6 |
| Embodiment 12 | 48 (100%) | 33.6 | 31.5 | 93.3 |
| Embodiment 13 | 60 (125%) | 42.0 | 40.1 | 95.6 |
| Embodiment 14 | 72 (150%) | 50.4 | 46.5 | 92.4 |
| Embodiment 15 | 84 (175%) | 58.8 | 56.1 | 95.3 |

A loss rate for each flavoring amount in the tube filter may be found from Table 9. As shown in Table 9, loss rates of flavor are approximately 6% on average, and therefore, it is found that loss of flavor caused due to high-temperature steam, which necessarily follows processes of forming and manufacturing of the tube filter, is not significant.

TABLE 10

| classification | flavoring liquid *286 (mg/80 mm) | menthol input amount (mg/80 mm) | flavoring nozzle/ steam nozzle separation distance (mm) | menthol content in tube filter (mg/80 mm) | input/ output (%) |
|---|---|---|---|---|---|
| Embodiment 11 | 36 | 25.2 | 200 | 24.1 | 95.6 |
| Comparative Example 3 | | | 50 | 10.7 | 42.5 |
| Comparative Example 4 | | | 100 | 11.2 | 44.4 |
| Comparative Example 5 | | | 150 | 14.0 | 55.5 |
| Comparative Example 6 | | | 400 | 20.0 | 79.3 |

From Table 10, loss rates of the flavor according to separation distances between the flavoring nozzle (that is, the plastic rod nozzle 3100 shown in FIG. 7) and the steam nozzle may be found. As shown in Table 10, in Comparative Examples 3 through 5, in which separation distances are 150 mm or less, it is found that the menthol content in the tube compared to the input amount of the menthol is 60% or less due to loss of flavor influenced by high-temperature steam. That is, the loss rate of the flavor is 40% or greater.

In Comparative Example 6 in which a separation distance is 400 mm, it is found that the loss rate of the flavor rather increased compare to that of Embodiment 11, which is presumably because the flavoring liquid spraying position is too far from the steam spraying position, so the tube is overly hardened beyond the hardness of the tube filter optimized for insertion and diffusion of the flavor while being transferred to the flavoring nozzle.

Experimental Example 9: Analysis on Migration Patterns of Menthol Flavor During Storage of Cigarettes To check a migration pattern of the menthol flavor over time in a cigarette including the internal-flavored tube filter, menthol contents of respective segments are analyzed by separating the segments of the cigarette according to elapsed periods.

As shown in Table, 11, a total amount of menthol in the second week from manufacture in Embodiment 11 increased by about 38% compared to a total amount of menthol in the second week from manufacture in Comparative Example 2, and a total amount of menthol in the fourth week from manufacture in Embodiment 11 increased by about 45% compared to a total amount of menthol in the fourth week from manufacture of Comparative Example 2. In Comparative Example 2 and Embodiment 11, a menthol content in the acetate portion (that is, the mouthpiece portion) in the fourth weeks from manufacture in Comparative Example 2 decreased by about 4.2% compared to the second week from manufacture, but on the other hand, a menthol content in the fourth week in Embodiment 11 decreased by about 0.1% compared to the second week.

Therefore, it is found that the loss rate of the flavor, especially a loss rate of the flavor in the acetate portion in Embodiment 11 where the internally-flavored tube filter is applied is noticeably less than that of Comparative Example 2 to which the internally-flavored tube filter is not applied.

A menthol content in the medium portion in the fourth week in Embodiment 11 increased by about 0.15 mg compared to the menthol content of the medium portion in the second week, and a total amount of menthol in the fourth week in Comparative Example 2 increased by about 0.08 mg compared to a total amount of menthol compared to the total amount of menthol in the fourth week in Comparative Example 2.

According to the above-described result, it is expected that the cigarette in Embodiment 11, to which the internally-flavored tube filter is applied, will be more advantageous in terms of the amount of migration of menthol during smoking compared to the cigarette in Comparative Example 2, to which the internally-flavored tube filter is not applied.

TABLE 11

| | | a menthol content for each segment mg/piece (%) | | | | | | |
|---|---|---|---|---|---|---|---|---|
| classification | time elapsed | acetate portion | cooling portion | tube portion | medium | outer cover | wrapper | Total |
| Comparative Example 2 | Two weeks | 3.33 (50.9%) | 0.14 (2.1%) | 1.16 (17.8%) | 1.09 (16.6%) | 0.49 (7.6%) | 0.33 (5.0%) | 6.53 (100%) |
| | Four weeks | 2.90 (46.7%) | 0.15 (2.4%) | 1.22 (19.6%) | 1.17 (18.8%) | 0.47 (7.6%) | 0.30 (4.9%) | 6.22 (100%) |
| Embodiment 11 | Two weeks | 3.36 (37.1%) | 0.20 (2.2%) | 2.92 (32.3%) | 1.59 (17.6%) | 0.58 (6.4%) | 0.40 (4.4%) | 9.05 (100%) |
| | Four weeks | 3.35 (37.0%) | 0.21 (2.3%) | 2.82 (31.2%) | 1.74 (19.3%) | 0.58 (6.4%) | 0.35 (3.9%) | 9.04 (100%) |

Experimental Embodiment 10: Analysis on Smoke Components of the Cigarettes to which the Internally-Flavored Tube Filters are Applied To analyze smoke components of the cigarettes to which the internally-flavored tube filters are applied, smoke components of the main stream smoke are analyzed for the cigarettes in Comparative Example 2 and Embodiment 11 after two weeks from manufacture.

TABLE 12

| classification | TPM (mg) | Tar (mg) | Nicotine (mg) | PG (mg) | Glycerin (mg) | moisture (mg) | menthol (mg) |
|---|---|---|---|---|---|---|---|
| Comparative Example 2 | 44.9 | 14.3 | 0.91 | 0.31 | 4.74 | 29.7 | 1.65 |
| Embodiment 11 | 45.9 | 15.4 | 0.93 | 0.48 | 5.22 | 29.6 | 2.13 |

As shown in Table 12, it is found that amounts of the components except the menthol content do not show significant differences in Comparative Example 1 and Embodiment 11, but on the other hand, an amount of migration of menthol increased by about 29% in Embodiment 11 compared to that of Comparative Example 2.

Experimental Example 11: Analysis on a Residual Amount of Menthol after Smoking

After smoking the cigarettes in Embodiment 11 and Comparative Example 2, the segments of the cigarettes are separated for analysis on an amount of menthol, an amount of nicotine, and an amount of glycerin remaining in each segment.

TABLE 13

| classification | | a residual amount after smoking mg/cigarette | | | |
|---|---|---|---|---|---|
| | | acetate portion | cooling portion | tube filter | Total |
| Comparative Example 2 | menthol | 1.36 | 0.14 | 0.48 | 1.98 |
| | nicotine | 0.41 | 0.20 | 0.43 | 1.04 |
| | glycerin | 5.97 | 0.50 | 8.96 | 15.4 |
| Embodiment 11 | menthol | 1.47 | 0.20 | 0.80 | 2.46 |
| | nicotine | 0.43 | 0.19 | 0.41 | 1.03 |
| | glycerin | 5.79 | 0.44 | 9.23 | 15.5 |

As shown in Table 13, there was substantially no difference in the residual amount of nicotine and glycerin of each segment between Comparative Example 2 and Embodiment 11, but the residual amount of menthol for each segment was 24% higher in Embodiment 11 compared to Comparative Example 2.

Comparative Example 7

A heating-type cigarette having a same structure as the smoking article 100 shown in FIG. 4 is used. That is, the heating-type cigarette includes a medium portion, a tube filter, a cooling filter, and a mouthpiece. The cooling filter is formed of poly lactic acid (PLA) fabric.

Internal flavoring/moisturizing processes are not performed on the tube filter having a length of 10 mm and an inner diameter of 2.5 mm, and a 12 mm-long TJNS filter, on which 6 mg of menthol flavor has been sprayed, is used as the mouthpiece.

Embodiment 16

A heating-type cigarette is manufactured under same conditions as those of Comparative Example 7, except using a 10 mm-long tube filter on which internal moisturizing process has been performed by using a 6 mg (that is, 100% of a menthol flavor content of the TJNS filter) of moisturizer. A PG content in the moisturizer is about 20%, and a glycerin content is about 80%.

Embodiment 17

A heating-type cigarette is manufactured under same conditions as those of Comparative Example 7, except using a 10 mm-long tube filter on which internal moisturizing treatment has been performed by using 9 mg (that is, 150% of menthol flavor content of the TJNS filter of moisturizer.

Comparative Example 8

A heating-type cigarette having a same structure as the smoking article 200 shown in FIG. 5 is used. That is, the heating-type cigarette includes a medium portion, a tube filter, a cooling tube filter, and a mouthpiece. The cooling tube filter has a tube shape having a hollow, like the tube filter, and an inner diameter of the cooling tube filer is 4.2 mm.

Internal flavoring/moisturizing processes are not performed on the tube filter having a length of 10 mm and an inner diameter of 2.5 mm, and internal flavoring/moisturizing processes are also not performed on the cooling tube filter having a length of 14 mm and an inner diameter of 4.2 mm. A 12 mm-long TJNS filter, on which 6 mg of menthol flavor has been sprayed, is used as the mouthpiece.

Embodiment 18

A heating-type cigarette is manufactured under the same conditions as those of Comparative Example 8, except using a 14 mm-long tube filter on which internal moisturizing treatment has been performed by using 7.5 mg (that is, 120% of the menthol flavor content of the TJNS filter) of moisturizer. A PG content in the moisturizer is about 20%, and a glycerin content is about 80%.

Embodiment 19

A heating-type cigarette is manufactured under the same conditions as those of Comparative Example 8, except using a 14 mm-long tube filter on which internal moisturizing treatment has been performed by using 9 mg (that is, 150% of the menthol flavor content of the TJNS filter) of moisturizer.

Embodiment 20

A 10 mm-long tube filter on which internal flavoring treatment has been performed by using 6 mg (that is, about 100% of menthol flavor content of the TJNS filter) is used, and a 14 mm-long cooling tube filter on which internal moisturizing treatment has been performed by using 9 mg (that is, 150% of the menthol flavor content of the TJNS filter) of moisturizer is used. Except the above-described condition, a heating-type cigarette is manufactured under the same conditions as those of Comparative Example 8.

Embodiment 21

A 10 mm-long tube filter on which internal moisturizing treatment has been performed by using 9 mg (that is, 150% of the menthol flavor content of the TJNS filter) is used, and a 14 mm-long cooling tube filter on which internal flavoring treatment has been performed by using 6 mm (that is, about 100% of the menthol flavor content of the TJNS filter) of menthol flavor is used. Except the above-described condition, a heating-type cigarette is manufactured under same conditions as those of Comparative Example 8.

Experimental 12: Evaluation on Physical Properties of a Cigarette to which the Internally-Flavored Tube Filter is Applied To examine change in physical properties of the cigarette according to flavoring and moisturizing of the tube filter and/or the cooling tube filter, weights, hardness, circumferences, and circularities of the cigarettes in the above-described Comparative Examples 7 and 8, Embodiments 16 through 21 are analyzed and shown in Table 15.

Table 14 shows specifications of the cigarettes according to the Comparative Example 7 and 8 and Embodiments 16 through 21.

TABLE 14

| classification | MTΦ2.5 | cooling member | | acetate filter |
|---|---|---|---|---|
| Comparative Example 7 | moisturizing 0 mg/10 mm (0%) | PLA fabric 120 | | (menthol: 6.0 mg/12 mm) |
| Embodiment 16 | moisturizing 6 mg/10 mm (100%) | | | |
| Embodiment 17 | moisturizing 9 mg/10 mm (150%) | | | |
| Comparative Example 8 | non-flavored/ non-moisturized | CFTΦ4.2 (220) | moisturizer 0 mg/14 mm (0%) | |
| Embodiment 18 | | | moisturizer 7.5 mg/14 mm (120%) | |
| Embodiment 19 | | | moisturizer 9 mg/14 mm (150%) | |
| Embodiment 20 | flavoring 6 mg/10 mm (100%) | | moisturizer 9 mg/14 mm (150%) | |
| Embodiment 21 | moisturizing 9 mg/10 mm (150%) | | flavoring 6 mg/10 mm (100%) | |

TABLE 15

| classification | weight (mg) | hardness (%) | circumference (mm) | circularity (%) |
|---|---|---|---|---|
| Comparative Example 7 | 502.0 | 93.1 | 22.50 | 96.8 |
| Embodiment 16 | 524.5 | 88.3 | 22.61 | 95.3 |
| Embodiment 17 | 544.1 | 86.1 | 22.65 | 94.9 |
| Comparative Example 8 | 675.2 | 61.7 | 22.7 | 96.0 |
| Embodiment 18 | 688.0 | 62.8 | 22.7 | 95.7 |
| Embodiment 19 | 692.3 | 62.6 | 22.7 | 95.4 |
| Embodiment 20 | 701.5 | 61.2 | 22.8 | 95.5 |
| Embodiment 21 | 703.3 | 61.1 | 22.7 | 95.1 |

As shown in Table 15, there is tendency that the weight of the cigarette slightly increases in proportion to the amount of the flavoring liquid/moisturizer, but the physical properties meet the standard of mass production with little differences from Comparative Examples 7 and 8 where a cigarette is not flavored or moisturized.

Experimental Example 13: Analysis on Cooling Effects During Smoking of Cigarettes to which Internally-Flavored/Moisturized Tube Filters are Applied To examine change in physical properties of the cigarette according to application of flavoring and/or moisturizing treatment on the inside of the tube filter and/or the cooling tube filter, temperatures of main stream smoke of the cigarettes in the above-described Comparative Examples 7 and 8 and Embodiments 16 to 21 are measured and shown in Table 16.

TABLE 16

| classification | maximum temperature | minimum temperature | average temperature (30 sec) |
|---|---|---|---|
| Comparative Example 7 | 77.3 | 46.6 | 60.5 |
| Embodiment 16 | 70.9 | 42.8 | 55.8 |
| Embodiment 17 | 65.5 | 42.7 | 53.9 |
| Comparative Example 8 | 78.3 | 48.2 | 67.0 |
| Embodiment 18 | 66.0 | 42.1 | 53.4 |
| Embodiment 19 | 64.9 | 41.0 | 53.3 |
| Embodiment 20 | 64.1 | 40.7 | 52.9 |
| Embodiment 21 | 64.3 | 40.5 | 53.1 |

As shown in Table 16, both Embodiments 16 and 17 show main smoke temperatures lower than those of Comparative Example 7, and all of Embodiments 18 through 21 show main smoke temperatures lower than those of Comparative Example 8.

Particularly, Embodiment 17, in which 150% of moisturizer is applied to the inside of the tube filter, is analyzed to have a maximum temperature which is about 12° C. lower and an average temperature which is about 6° C. lower, compared to Comparative Example 7.

In addition, Embodiments 19 to 21, in which 150% of moisturizer is applied to the inside of the cooling tube filter, are analyzed to have a maximum temperature which is about 13° C. lower and an average temperature which is about 14° C. lower, compared to Comparative Example 8.

Experimental Example 14: Analysis on Smoke Components During Smoking of Cigarettes to which Internally-Flavored/Moisturized Tube Filters are Applied For analysis on smoke components of the cigarette, smoke components of main stream smoke of the cigarettes two weeks after being manufactured according to Comparative Examples 7 and 8, and Embodiments 16 through 21 are analyzed and shown in Table 17. Amounts of migration of menthol in Embodiments 20 and 21 in which flavoring treatment and moisturizing treatment were performed are separately shown in Table 18.

TABLE 17

| classification | TPM (mg) | Tar (mg) | Nicotine (mg) | PG (mg) | Glycerin (mg) | moisture (mg) |
|---|---|---|---|---|---|---|
| Comparative Example 7 | 44.0 | 20.3 | 1.02 | 0.48 | 3.79 | 22.69 |
| Embodiment 16 | 44.1 | 20.1 | 1.07 | 0.55 | 3.89 | 24.14 |
| Embodiment 17 | 44.5 | 21.2 | 1.09 | 0.66 | 4.34 | 22.28 |
| Comparative Example 8 | 43.9 | 18.2 | 0.83 | 0.07 | 3.14 | 24.4 |
| Embodiment 18 | 43.5 | 18.3 | 0.85 | 0.11 | 3.21 | 24.7 |
| Embodiment 19 | 43.1 | 18.5 | 0.87 | 0.12 | 3.26 | 24.1 |
| Embodiment 20 | 43.5 | 19.3 | 1.05 | 0.32 | 3.66 | 25.7 |
| Embodiment 21 | 43.4 | 18.9 | 0.95 | 0.42 | 3.50 | 25.1 |

As shown in Table 17, both Embodiments 16 and 17 show higher nicotine contents in main stream smoke compared to Comparative Example 7, and all of Embodiments 18 through 21 show higher nicotine contents in main stream smoke compared to Comparative Example 8. From the result, it is expected the cigarettes in Embodiments 16 through 21 (especially, in Embodiments 17 and 19 through 21) may provide better taste and higher satisfaction during smoking than the cigarettes in the Comparative Examples.

In addition, although not shown in the Table 17, according to the above-described experiment, the cigarettes in the Embodiments 16 through 20 produce greater amount of smoke than those in the Comparative Examples.

In addition, in Embodiments 20 and 21 in which a tube filter is internally-flavored by using menthol flavor and a cooling tube filter is internally moisturized by using the moisturizer, it is found that satisfaction of flavor during smoking increased as well as the amount of nicotine and an amount of smoke.

TABLE 18

| separation | amount of migration of menthol (mg) | increase rate compared to Comparative Example 1 (%) |
|---|---|---|
| Comparative Example 8 | 1.50 | — |
| Embodiment 20 | 1.95 | 30.0% |
| Embodiment 21 | 2.15 | 43.3% |

As shown in Table 18, it is found that the amounts of migration of menthol have increased, compared to Comparative Example 8, in both of Embodiments 20 and 21 in which moisturizing treatment and flavoring treatment have been performed. Especially, in Embodiment 21 in which moisturizing treatment is performed on a first tube MT at the upstream and flavoring treatment is performed on a second tube (that is, a cooling filter tube (CFT)) disposed between the first tube MT and the acetate filter (TJNS filter), it is found the amount of migration of menthol is higher than that of Embodiment 20.

As shown in Tables 15 through 17, considering there were no significant differences except the amounts of migration of menthol between Embodiments 20 and 21, it is found that cooling performance was similar in Embodiments 20 and 21. However, Embodiment 21 turns out to be more advantageous in terms of loss of flavor, and it is presumed that the loss of flavor due to heat of the aerosol is minimized as the internally-flavored tube filter is between the internally-moisturized tube filter and the TJNS filter.

Experimental Example 15: Evaluation on Smoking Feeling of Cigarettes to which Internally-Flavored Tube Filters are Applied A tube filter on which internal flavoring treatment has been performed by using menthol of the same amount as menthol included in the mouthpiece is used. The cigarette in Embodiment 9 having the same structure as the smoking article 300 shown in FIG. 6, and a tube filter on which internal flavoring treatment has been performed by using menthol of the same amount as menthol included in the mouthpiece are used. Sensory evaluation during smoking/after smoking according to the cigarette in Embodiment 12 having the same structure as the smoking article 200 shown in FIG. 5 is performed.

The evaluation was conducted on a total of sixty one evaluation panel members, based on a 0 to 7 rating scale.

Figure 9:
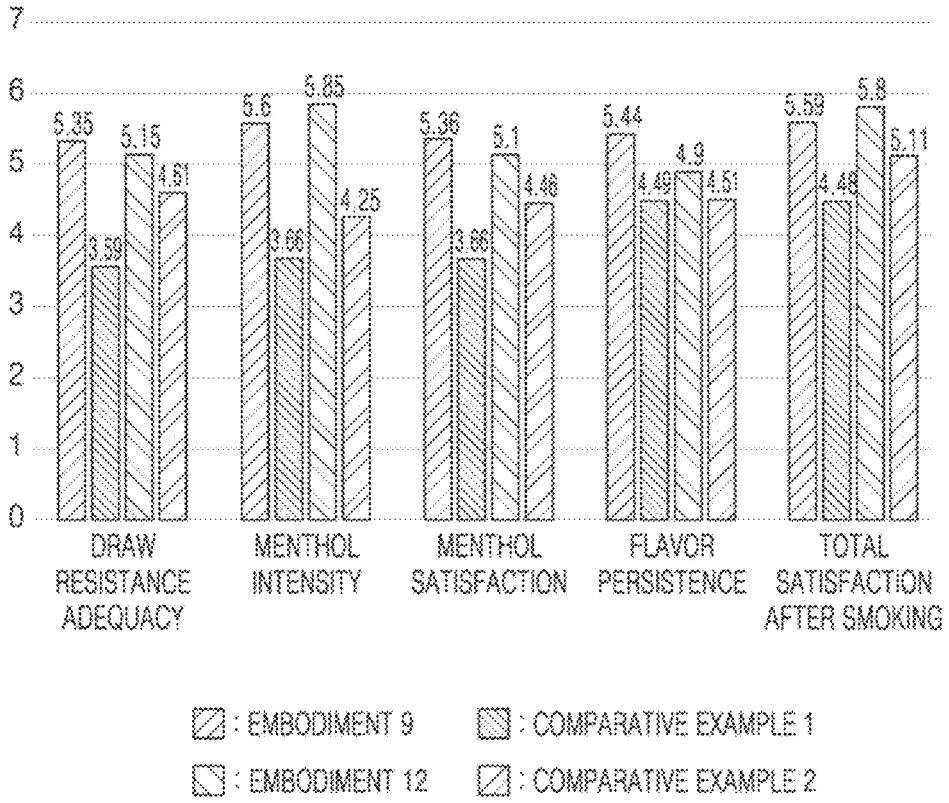
FIG. 9 shows a result of satisfaction assessment of smoking articles according to some embodiments of the present disclosure.

FIG. 9 shows a result of satisfaction assessment of smoking articles according to some embodiments of the present disclosure.

As shown in FIG. 9, the scores in draw resistance adequacy, menthol intensity, and menthol flavor satisfaction during smoking in Embodiment 9 are higher than those of Comparative Example 1. Also, all scores in Embodiment 12 were higher than those of Comparative Example 2.

Particularly, the menthol intensity during smoking in Embodiment 9 increased by about 53% compared to that of Comparative Example 1, and in Embodiment 12, increased by about 36% compared to that of Comparative Example 2. At the same time, total satisfaction after smoking increased in Embodiment 9 by about 25% compared to that of Comparative Example 1, and increased in Embodiment 12 by about 13% compared to that of Comparative Example 2. Accordingly, it is found that the taste of menthol during smoking may be improved and general smoking satisfaction may also be improved during smoking when the internally-flavored tube filter according to the embodiments of the present disclosure is used.

As described above, according to a filter for a smoking article and a smoking article according to the embodiments of the present disclosure, hand odor and bad breath caused after smoking may be reduced.

Those of ordinary skill in the art related to the present embodiments may understand that various changes in form and details can be made therein without departing from the scope of the characteristics described above. The disclosed methods should be considered in a descriptive sense only and not for purposes of limitation. The scope of the present disclosure is represented in the claims rather than the above description, and all differences within the scope equivalent thereto should be construed as being included in the present disclosure.

The invention claimed is:

1. A method of manufacturing a smoking article comprising a tube filter, the method comprising:

preparing a smoking material portion, a first tube filter flavored by a first flavoring liquid, and a mouthpiece flavored by a second flavoring liquid; and combining and packaging the smoking material portion, the first tube filter, and the mouthpiece with a wrapper, wherein the preparing comprises:

spraying, by a steam spray nozzle, steam of 80° C. to 150° C. onto an external surface of a tube-shaped rod for the first tube filter; and subsequently applying the first flavoring liquid inside the first tube filter through a hollow of the first tube filter by using a flavoring nozzle, and wherein the flavoring nozzle and the steam spray nozzle are apart from each other by 180 mm to 350 mm in a longitudinal direction of the first tube filter.

2. The method of claim 1, wherein the applying further comprises applying the first flavor liquid to an inner surface of the first tube filter in an amount of 0.3 mg to 1.0 mg per millimeter.

3. The method of claim 2, wherein the applying further comprises:

applying the first flavoring liquid to the inner surface in an amount of 0.3 mg to 0.6 mg per millimeter, using the flavoring nozzle having a diameter of 0.8 mm to 1.1 mm, or applying the first flavoring liquid to the inner surface in an amount of 0.7 mg to 1.0 mg per millimeter, using the flavoring nozzle having a diameter of 1.2 mm to 1.4 mm.

4. The method of claim 3, wherein the preparing further comprises:

cutting the tube-shaped rod into the first tube filter after the first flavoring liquid is applied, wherein the first flavoring liquid contained in the first tube filter after the cutting is from 92% to 99.9% of a total amount of the first flavoring liquid applied to the first tube filter before the cutting.

5. The method of claim 1, wherein an amount of the first flavoring liquid applied in the hollow of the first tube filter is 10% to 200% of an amount of the second flavoring liquid applied in the mouthpiece.

* * * * *